US010631103B2

(12) United States Patent
Lim et al.

(10) Patent No.: US 10,631,103 B2
(45) Date of Patent: Apr. 21, 2020

(54) SYSTEM AND METHOD FOR MULTIPLEXED ULTRASOUND HEARING

(71) Applicant: Regents of the University of Minnesota, Minneapolis, MN (US)

(72) Inventors: Hubert H. Lim, Minneapolis, MN (US); Hongsun Guo, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 15/992,738

(22) Filed: May 30, 2018

(65) Prior Publication Data

US 2018/0352344 A1 Dec. 6, 2018

Related U.S. Application Data

(60) Provisional application No. 62/512,388, filed on May 30, 2017.

(51) Int. Cl.
*H04R 25/00* (2006.01)

(52) U.S. Cl.
CPC ..... *H04R 25/48* (2013.01); *H04R 25/606* (2013.01); *H04R 25/75* (2013.01); *H04R 25/353* (2013.01); *H04R 2460/13* (2013.01)

(58) Field of Classification Search
CPC ..... H04R 25/353; H04R 25/606; H04R 2217/03; H04R 2460/13
See application file for complete search history.

(56) References Cited

U.S. PATENT DOCUMENTS 4,419,544 A * 12/1983 Adelman ..... H04R 25/353 381/316
4,982,434 A * 1/1991 Lenhardt ..... H04R 25/606 381/316

(Continued)

FOREIGN PATENT DOCUMENTS

DE 102015106560 11/2016
JP 2002300700 A * 10/2002
RU 2134092 8/1999

OTHER PUBLICATIONS

Snyder, R.L., et al. (2004). Topographic spread of inferior colliculus activation in response to acoustic and intracochlear electric stimulation. J. Assoc. Res. Otolaryngol. 5, 305-322.

(Continued)

*Primary Examiner* — Fan S Tsang
*Assistant Examiner* — Ryan Robinson
(74) *Attorney, Agent, or Firm* — Quarles & Brady LLP

(57) ABSTRACT

A hearing system for stimulating an auditory system for sound perception by activating a particular region of a cochlea of a user using ultrasound signals, the particular region corresponding to a target frequency range, the system including: an ultrasonic transducer configured to deliver an ultrasound signal via an interface medium; and a processor communicatively coupled to the ultrasonic transducer, the processor to: obtain an audio signal, extract at least one of a temporal feature or a spectral feature from the audio signal, transpose the audio signal to the target frequency range based on extracting the at least one of the temporal feature or the spectral feature from the audio signal, generate a modulated ultrasound signal based on modifying a carrier signal having at least one frequency between 100 kHz and 4 MHz by the transposed audio signal, and provide the (Continued)

modulated ultrasound signal to the ultrasonic transducer for delivery via an interface medium.

32 Claims, 17 Drawing Sheets

(56) References Cited

U.S. PATENT DOCUMENTS

| | | | | |
|---|---|---|---|---|
| 5,285,499 | A * | 2/1994 | Shannon | H04R 25/353 381/312 |
| 6,068,590 | A * | 5/2000 | Brisken | H04R 25/606 600/25 |
| 6,169,813 | B1 * | 1/2001 | Richardson | H04R 25/353 381/312 |
| 6,173,062 | B1 * | 1/2001 | Dibachi | H04R 25/353 381/312 |
| 6,217,508 | B1 * | 4/2001 | Ball | H04R 11/02 600/25 |
| 6,377,693 | B1 * | 4/2002 | Lippa | A61F 11/045 381/71.1 |
| 6,394,969 | B1 * | 5/2002 | Lenhardt | A61F 11/00 601/2 |
| 6,577,739 | B1 * | 6/2003 | Hurtig | H04R 25/353 381/106 |
| 6,631,196 | B1 * | 10/2003 | Taenzer | H04B 1/04 381/312 |
| 6,631,197 | B1 * | 10/2003 | Taenzer | H04R 25/606 381/312 |
| 6,731,769 | B1 * | 5/2004 | Lenhardt | H04R 25/502 381/316 |
| 7,088,224 | B2 * | 8/2006 | Nakagawa | H04R 25/606 340/4.11 |
| 8,107,647 | B2 * | 1/2012 | Lenhardt | H04R 17/10 381/151 |
| 8,189,839 | B2 * | 5/2012 | Lenhardt | H04R 25/353 381/312 |
| 8,571,242 | B2 * | 10/2013 | Bachler | H04R 25/353 363/16 |
| 8,929,575 | B2 * | 1/2015 | Norris | H04R 25/50 381/312 |
| 9,621,973 | B2 * | 4/2017 | Stauber | H04R 1/02 |
| 10,039,672 | B2 * | 8/2018 | Aghamohammadi | A61F 11/04 |
| 2001/0051776 | A1 * | 12/2001 | Lenhardt | A61B 8/0808 601/2 |
| 2004/0196998 | A1 * | 10/2004 | Noble | H04R 25/606 381/331 |
| 2004/0202339 | A1 | 10/2004 | O'Brien | |
| 2012/0053391 | A1 | 3/2012 | Mishelevich | |
| 2014/0355800 | A1 * | 12/2014 | Kang | H04R 25/00 381/315 |
| 2015/0126802 | A1 * | 5/2015 | Lim | A61H 23/0236 600/13 |
| 2016/0249138 | A1 * | 8/2016 | Van Der Werf | H04R 25/353 |
| 2016/0269833 | A1 * | 9/2016 | Norris | H04R 17/005 |
| 2016/0337750 | A1 * | 11/2016 | Louis | H04R 1/403 |
| 2017/0318397 | A1 * | 11/2017 | Lim | H04R 25/606 |
| 2018/0117328 | A1 * | 5/2018 | Herrmann | H04R 25/606 |

OTHER PUBLICATIONS

Sohmer, H., et al. (2004). Further evidence for a fluid pathway during bone conduction auditory stimulation. Hear. Res. 193, 105-110.

Stein, B.E., et al. (2008). Multisensory integration: current issues from the perspective of the single neuron. Nat. Rev. Neurosci. 9, 255-266.

Straka, M.M., et al. (2015). Descending and tonotopic projection patterns from the auditory cortex to the inferior colliculus. Neuroscience 300, 325-337.

Straka, M.M., et al. (2013). Neural integration and enhancement from the inferior colliculus up to different layers of auditory cortex. J. Neurophysiol. 110, 1009-1020.

Straka, M.M., et al. (2014). Response features across the auditory midbrain reveal an organization consistent with a dual lemniscal pathway. J. Neurophysiol. 112, 981-998.

Tsirulnikov et al., "Use of Amplitude-Modulated Focused Ultrasound for diagnosis of Hearing Disorders", Ultrasound in Med & Biol, vol. 14, No. 4, pp. 277-285, Oct. 1987.

Tufail, Y., et al. (2010). Transcranial pulsed ultrasound stimulates intact brain circuits. Neuron 66, 681-694.

Tufail, Y., et al. (2011). Ultrasonic neuromodulation by brain stimulation with transcranial ultrasound. Nat. Protoc. 6, 1453-1470.

Turner, J.G., et al. (2006). Gap detection deficits in rats with tinnitus: a potential novel screening tool. Behav. Neurosci. 120, 188-195.

Tyler, W.J., et al. (2008). Remote excitation of neuronal circuits using low-intensity, low-frequency ultrasound. PLoS ONE 3, e3511.

Wallace, M.N., et al. (2000). Identification and localisation of auditory areas in guinea pig cortex. Exp. Brain Res. 132, 445-456.

Wang, Y., et al. (2008). Visuo-auditory interactions in the primary visual cortex of the behaving monkey: electrophysiological evidence. BMC Neurosci. 9, 79.

Wattiez, N., et al. (2017). Transcranial ultrasonic stimulation modulates singleneuron discharge in macaques performing an antisaccade task. Brain Stimulat. 10, 1024-1031.

Wright, C.J., et al. (2017). Unmyelinated peripheral nerves can be stimulated in vitro using pulsed ultrasound. Ultrasound Med. Biol. 43, 2269-2283.

Yamashita, Akinori, et al. "Comparison between bone-conducted ultrasound and audible sound in speech recognition." Acta Oto-Laryngologica 129.sup562 (2009): 34-39.

Ye, P.P., et al. (2016). Frequency dependence of ultrasound neurostimulation in the mouse brain. Ultrasound Med. Biol. 42, 1512-1530.

Yoo, S.-S., et al. (2011). Focused ultrasound modulates region-specific brain activity. Neuroimage 56, 1267-1275.

Aitkin, L.M., et al. (1981). The representation of the auditory and somatosensory systems in the external nucleus of the cat inferior colliculus. J. Comp. Neurol. 196, 25-40.

Brunoni, A.R., et al. (2011). A systematic review on reporting and assessment of adverse effects associated with transcranial direct current stimulation. Int. J. Neuropsychopharmacol. 14, 1133-1145.

Bystritsky, A., et al. (2015). A review of low-intensity transcranial focused ultrasound for clinical applications. Curr. Behav. Neurosci. Rep. 2, 60-66.

Bystritsky, A., et al. (2011). A review of low-intensity focused ultrasound pulsation. Brain Stimulat. 4, 125-136.

Clemo, H.R., et al. (2007). Auditory projections to visual cortex: synaptic basis for multisensory processing in 'unimodal' visual neurons. J. Vis. 7, 864-864.

Davis, M. (1970). Effects of interstimulus interval length and variability on startle-response habituation in the rat. J. Comp. Physiol. Psychol. 72, 177-192.

Deng, Z.-D., et al. (2013). Electric field depth-focality tradeoff in transcranial magnetic stimulation: simulation comparison of 50 coil designs. Brain Stimulat. 6, 1-13.

Foxe, J.J., et al. (2000). Multisensory auditory-somatosensory interactions in early cortical processing revealed by high-density electrical mapping. Brain Res. Cogn. Brain Res. 10, 77-83.

Fry, F.J., et al. (1958). Production of reversible changes in the central nervous system by ultrasound. Science 127, 83-84.

Fukushima, Ariko, et al. "Frequencies of inaudible high-frequency sounds differentially affect brain activity: positive and negative hypersonic effects." PloS one 9.4 (2014): e95464.

Geyer, M.A., et al. (2001). Measurement of startle response, prepulse inhibition, and habituation. Curr. Protoc. Neurosci. Chapter 8, 8.7.1-8.7.15.

Glowa, J.R., et al. (1994). Differences in response to an acoustic startle stimulus among forty-six rat strains. Behav. Genet. 24, 79-84.

Gopen, Q., et al. (1997). Anatomy of the normal human cochlear aqueduct with functional implications. Hear. Res. 107, 9-22.

Grimsley, C.A., et al. (2015). An improved approach to separating startle data from noise. J. Neurosci. Methods 253, 206-217.

Gruters, K.G., et al. (2012). Sounds and beyond: multisensory and other non-auditory signals in the inferior colliculus. Front. Neural Circuits 6, 96.

(56) References Cited

OTHER PUBLICATIONS

Guo, Hongsun, et al. "Ultrasound produces extensive brain activation via a cochlear pathway." Neuron 98.5 (2018): 1020-1030.
Hallett, M. (2000). Transcranial magnetic stimulation and the human brain. Nature 406, 147-150.
Huang, C.L., et al. (2000). Auditory thalamocortical projections in the cat: laminar and areal patterns of input. J. Comp. Neurol 427, 302-331.
Ito, K., et al. (2010). Perception mechanisms of bone-conducted ultrasound assessed by acoustic characteristics in the external auditory meatus. Jpn. J. Appl. Phys. 49, 07HF31.
Johnson, M.D., et al. (2013). Neuromodulation for brain disorders: challenges and opportunities. IEEE Trans. Biomed. Eng. 60, 610-624.
King, R.L., et al. (2014). Localization of ultrasoundinduced in vivo neurostimulation in the mouse model. Ultrasound Med. Biol. 40, 1512-1522.
King, R.L., et al. (2013). Effective parameters for ultrasound-induced in vivo neurostimulation. Ultrasound Med. Biol. 39, 312-331.
Kubanek, J., et al. (2016). Ultrasound modulates ion channel currents. Sci. Rep. 6, 24170.
Lee, W., et al. (2015). Image-guided transcranial focused ultrasound stimulates human primary somatosensory cortex. Sci. Rep. 5, 8743.
Lee, W., et al. (2016). Transcranial focused ultrasound stimulation of human primary visual cortex. Sci. Rep. 6, 34026.
Legon et al., "Transcranial focused ultrasound modulates the activity of primary somatosensory cortex in humans", Nat Neurosci, vol. 17, No. 2, pp. 322-329, Feb. 2014.
Legon et al., "Transcranial focused ultrasound neuromodulation of the human primary motor cortex", (2018) bioRxiv, doi: https://doi.org/10.1101/234666.
Lim, H.H., et al. (2006). Auditory cortical responses to electrical stimulation of the inferior colliculus: implications for an auditory midbrain implant. J. Neurophysiol. 96, 975-988.
Lim, H.H., et al. (2007). Spatially distinct functional output regions within the central nucleus of the inferior colliculus: implications for an auditory midbrain implant. J. Neurosci. 27, 8733-8743.
Markovitz, C.D., et al. (2015). Pairing broadband noise with cortical stimulation induces extensive suppression of ascending sensory activity. J. Neural Eng. 12, 026006.
Markovitz, C.D., et al. (2015). Investigating a new neuromodulation treatment for brain disorders using synchronized activation of multimodal pathways. Sci. Rep. 5, 9462.
Markovitz, C.D., et al. (2013). Tonotopic and localized pathways from primary auditory cortex to the central nucleus of the inferior colliculus. Front. Neural Circuits 7, 77.
Markovitz, C.D., et al. (2012). Three-dimensional brain reconstruction of in vivo electrode tracks for neuroscience and neural prosthetic applications. Front. Neural Circuits 6, 39.
Mehic, E., et al. (2014). Increased anatomical specificity of neuromodulation via modulated focused ultrasound. PLoS ONE 9, e86939.
Middlebrooks, J.C. (2008). Auditory cortex phase locking to amplitude-modulated cochlear implant pulse trains. J.Neurophysiol 100, 76-91.
Nakagawa, S., et al. (2006). "Development of a bone-conducted ultrasonic hearing aid for the profoundly sensorineural deaf." Transactions of Japanese Society for Medical and Biological Engineering 44.1 (2006): 184-189.
Nakagawa, Seiji, et al. "Development of a novel hearing-aid for the profoundly deaf using bone-conducted ultrasonic perception: Evaluation of transposed modulation." 2013 35th Annual International Conference of the IEEE Engineering in Medicine and Biology Society (EMBC). IEEE, 2013.
Nishimura, Tadashi, et al. "An examination of the effects of broadband air-conduction masker on the speech intelligibility of speech-modulated bone-conduction ultrasound." Hearing research 317 (2014): 41-49.
Nishimura, Tadashi, et al. "Ultrasonic masker clarifies ultrasonic perception in man." Hearing research 175.1-2 (2003): 171-177.
Nitsche, M.A., et al. (2008). Transcranial direct current stimulation: State of the art 2008. Brain Stimulat. 1, 206-223.
Offutt, Sj., et al. (2014). Suppression and facilitation of auditory neurons through coordinated acoustic and midbrain stimulation: investigating a deep brain stimulator for tinnitus. J. Neural Eng. 11, 066001.
Okamoto, Yosuke, et al. "Intelligibility of bone-conducted ultrasonic speech." Hearing research 208.1-2 (2005): 107-113.
Oohashi, Tsutomu, et al. "Inaudible high-frequency sounds affect brain activity: hypersonic effect." Journal of neurophysiology 83.6 (2000): 3548-3558.
Perlmutter, J.S., et al. (2006). Deep brain stimulation. Annu. Rev. Neurosci. 29, 229-257.
Ramachandran, V.S., et al. (2009). The use of visual feedback, in particular mirror visual feedback, in restoring brain function. Brain 132, 1693-1710.
Rapisarda, C., et al. (1990). Multiple representations of the body and input-output relationships in the agranular and granular cortex of the chronic awake guinea pig. Somatosens. Mot. Res. 7, 289-314.
Sato, T., et al. (2018). Ultrasonic neuromodulation causes widespread cortical activation via an indirect auditory mechanism. Neuron. Published online May 24, 2018. https://doi.org/10.1016/j.neuron. 2018.05.009.
Schofield, B.R., et al. (2011). Cholinergic cells of the pontomesencephalic tegmentum: connections with auditory structures from cochlear nucleus to cortex. Hear. Res. 279, 85-95.
Sigrist, R., et al. (2013). Augmented visual, auditory, haptic, and multimodal feedback in motor learning: a review. Psychon. Bull. Rev. 20, 21-53.
Smith, P.H., et al. (2001). Fundamental differences between the thalamocortical recipient layers of the cat auditory and visual cortices. J. Comp. Neurol 436, 508-519.

* cited by examiner

SYSTEM AND METHOD FOR MULTIPLEXED ULTRASOUND HEARING

CROSS-REFERENCE TO RELATED APPLICATIONS

This application claims the benefit of U.S. Provisional Patent Application Ser. No. 62/512,388 filed on May 30, 2017, and entitled "System and Method for Multiplexed Ultrasound Hearing," which is incorporated by reference herein in its entirety.

FIELD OF THE INVENTION

This document concerns an invention relating generally to activation of an auditory system (involved in the perception of sounds) via ultrasound stimulation of cerebrospinal fluids, and more particularly, to delivery of ultrasound signals that stimulate unused or underutilized portions of the cochlea via cerebrospinal fluids (such as the edge cochlear regions not readily accessible through the normal bone conductive hearing pathway or middle cochlear regions that are not being activated at a certain time) to, for example, assist users in hearing speech in noisy environments or hearing multiple talkers at the same time. This approach could also be used in the treatment of tinnitus by activating underused portions of the cochlea not accessible through the normal hearing pathway in which a lack of activation drives the tinnitus perception in the brain.

BACKGROUND

Conventional hearing aids use a microphone to detect ambient sounds and a loudspeaker or earphone to send sounds into the ear canal to help patients hear when their ears are damaged or otherwise compromised. However, sounds from the loudspeaker or earphone may reach the microphone, causing acoustic feedback issues. Also, such hearing aids direct sounds to the ear through the natural conductive pathway (that is, through the ear drum and to the middle ear bones that vibrate fluids in the cochlea). Consequently, conventional hearing aids are inadequate for certain types of hearing loss caused by physical or genetic ear damage. Moreover, conventional hearing aids or commercial hearing devices suffer from smearing of temporal and spectral information that occurs when amplifying specific frequency bands of sound features to overcome deficits in hearing or for subjects listening in noisy environments interfering with those specific sound features. There are also patients who have tinnitus caused by loss of hearing in certain frequency ranges that can no longer be sufficiently accessed through the normal hearing pathway.

When using hearing aid devices, headphones/earbuds, phones, and other hearing and communication devices in noisy environments, it can be particularly difficult to hear speech sounds. This can occur during conversations in a noisy crowd or room, when someone is using a mobile phone, in a warzone in which soldiers are not able to hear each other during critical military operations, and noisy workplaces in which employees cannot easily communicate with each other to perform their work. Users may wear earplugs to block sounds from entering their ear canals, and some earplugs include speakers for sending to the user desired speech information provided by someone speaking into a phone or microphone device capable of transmitting the speech information wirelessly to the earplug's speakers. However, the ambient noise in the user's environment can still travel through the user's skull/head through bone vibration. Furthermore, those earplugs are not perfect in blocking unwanted sounds and noise, and those earplugs can be quite uncomfortable, especially when worn over a long period of time. The unwanted sound in these different scenarios is thus able to reach the cochlea, masking or otherwise interfering with the speech sounds also reaching the user's cochlea from the hearing or communication device.

SUMMARY OF THE PRESENT DISCLOSURE

A hearing system and method for activating an auditory system of a user via cerebrospinal fluids involves receiving audio signals and extracting temporal and spectral features from the audio signal to generate modulated ultrasound signals in a range of 50 kilohertz (kHz) to 4 megahertz (MHz). One or more ultrasonic transducers deliver the modulated signal to the user. Bypassing the conventional conductive pathway for audible sounds allows users with compromised hearing to perceive sounds. The frequencies of the audio signal are transposed such that the ultrasound signals activate edge regions (i.e., unused or underused portions) of the cochlea. A user is able to perceive the delivered sounds in a "channel" that is separate from the commonly-used portions of the cochlea that may be inundated with extraneous sounds in, for example, a noisy environment. Because different perceptual channels are used (i.e., normal conductive pathway channel and an ultrasound stimulation channel), the delivered noise is not masked by the ambient noises as it would be if both sounds shared the same channel (i.e., if both were heard through the normal conductive pathway). The hearing device could also present sound through middle regions of the cochlea if those regions are not being largely used by the normal conductive pathway at a given time and/or if the information can be sufficiently uncorrelated with the way in which ultrasound activates those middle regions to be perceived separately from each other. For tinnitus patients, providing better activation of underused cochlear regions could increase peripheral activity to the brain that could turn off or reduce the tinnitus. That is, this ultrasound hearing system could better activate the underused portions of the cochlea not readily accessible with the normal hearing pathway to reverse the over-compensation by the brain due to the compromised hearing, and thus shut down or reduce tinnitus perception.

In one embodiment, the invention provides a hearing system for stimulating an auditory system for sound perception by activating a particular region of a cochlea of a user using ultrasound signals, the particular region corresponding to a target frequency range, the system including: an ultrasonic transducer configured to deliver an ultrasound signal via an interface medium; and a processor communicatively coupled to the ultrasonic transducer, the processor to: obtain an audio signal, extract at least one of a temporal feature or a spectral feature from the audio signal, transpose the audio signal to the target frequency range based on extracting the at least one of the temporal feature or the spectral feature from the audio signal, generate a modulated ultrasound signal based on modifying a carrier signal having at least one frequency between 100 kHz and 4 MHz by the transposed audio signal, and provide the modulated ultrasound signal to the ultrasonic transducer for delivery via an interface medium.

In another embodiment, the invention provides a method for stimulating an auditory system for sound perception by activating a particular region of a cochlea of a user using ultrasound signals, the particular region corresponding with a target frequency range, the method including: obtaining, by a processor, an audio signal; extracting, by the processor, at least one of a temporal feature or a spectral feature from the audio signal; transposing, by the processor, the audio signal to the target frequency range based on extracting the at least one of the temporal feature or the spectral feature from the audio signal; generating, by the processor, a modulated ultrasound signal based on modifying a carrier signal having at least one frequency between 50 kHz and 4 MHz by the transposed audio signal; providing, by the processor, the modulated ultrasound signal to an ultrasonic transducer configured to deliver an ultrasound signal via an interface medium; and delivering, by the ultrasonic transducer, the modulated ultrasound signal to one or more portions of the body of the user to stimulate the cochlea via vibration of cochlear fluids.

These and other embodiments, aspects, advantages, and features of the present invention will be set forth in part in the description which follows, and will become apparent to those skilled in the art by reference to the following description of the invention and referenced drawings or by practice of the invention. The accompanying drawings illustrate one or more implementations, and these implementations do not necessarily represent the full scope of the invention.

Figure 1:
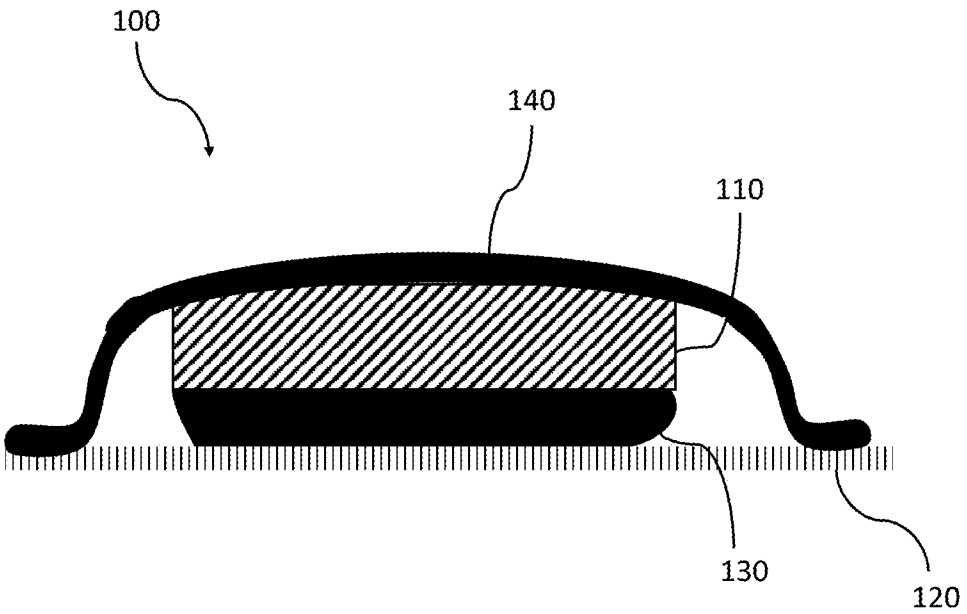
FIG. 1 is a schematic diagram of a portion of an ultrasonic hearing system according to one or more embodiments, depicting an example single wearable ultrasound transducer in contact with skin. A coupling gel, such as pads that can be periodically replaced, serves as an interface medium between the transducer and the skin. Sticky pads may be used to secure the transducer close to the skin so it is not necessary to press the transducer to the ear or head.

The following detailed description includes references to the accompanying drawings, which form a part of the detailed description. The drawings show, by way of illustration, specific embodiments in which the apparatus may be practiced. These embodiments, which are also referred to herein as "examples" or "options," are described in enough detail to enable those skilled in the art to practice the present embodiments. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents. In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

DETAILED DESCRIPTION OF THE PRESENT DISCLOSURE

Example systems and related methods are used to activate the auditory system using ultrasound as a novel hearing aid technology that addresses key challenges with conventional hearing aids. The auditory system is activated via the cochlea using ultrasound stimulation of, for example, the brain and brain/cerebrospinal fluids. Vibration of the brain and brain fluids in turn is able to lead to fluid vibrations in the cochlea through an inner ear tube/aqueduct connection that exists from the brain to the cochlea. This ultrasound-induced vibration of fluid in the cochlea then causes activation in the auditory brain to produce hearing sensation. This may be achieved by ultrasound stimulation applied at the head, or ultrasound stimulation of the body and the fluids in the body. Vibrations in different parts of the body are able to travel through the body to reach cerebrospinal fluids in the brain and spinal cord that directly connects with the fluids in the cochlea through the inner ear aqueduct. Ultrasound stimulation presented to the head of animals with and without the skull achieves similar auditory activation effects. Also, ultrasound stimulation to the body (e.g., neck or leg) is able to activate the cochlea and cochlear nerve cells, which is not possible when the fluid in the cochlea has been removed in the animals. Consequently, activation of the auditory brain with ultrasound using specified frequency ranges is not simply a "bone conductive" mechanism of activating the inner ear through the skull, as previously attempted using lower ultrasound frequencies (e.g., 20-50 kHz). Furthermore, modulated ultrasound carrier frequencies presented to cerebrospinal fluids and to cochlear fluids can mimic similar auditory brain activation patterns as occurs when presenting the desired acoustic stimulus through the natural pathway of the ear drum and middle ear bones to the cochlea. The high ultrasound carrier frequencies (e.g., 100 kHz to 4 MHz) enable the signal to pass across the skull/bones to reach the cerebrospinal fluids, in which the modulated waveform matching the desired acoustic stimulus is what reaches the cochlear fluids. In other words, the high ultrasound carrier frequencies serve to "carry" the desired modulated waveform through the skull/bones to the cochlear fluids via the cerebrospinal fluids. It is noted that cochlear fluids may also be directly vibrated by the ultrasound signals, something that may be promoted by, for example, aiming the transducers directly at the cochlea and/or using beamforming techniques.

Example systems and methods can use very low energies (shown to be safe in humans for imaging applications such as fetal imaging) with ultrasound frequencies between 100 kHz to 1 MHz, which are able to cause extensive auditory activation. In various implementations, power transfer may range from 1 to 500 milliwatts per square centimeter (mW/$cm^2$). The systems and methods also use modulated and ramped pulse patterns to systematically control temporal and frequency activation effects in the auditory system, which are key elements for hearing in the brain. In other words, ultrasound stimulation with varying modulation patterns can be used to induce hearing in the brain. Higher ultrasonic carrier frequencies may not be practical because they require much larger energies, which can be harmful to brain tissue. Consequently, using modulated and burst patterns within a preferred range of 100 kHz to 1 MHz (up to 4 MHz could also be used with more energy-efficient technologies/algorithms) helps enable ultrasound hearing devices that use low energy and are thus feasible for daily use (i.e., are able to be powered for many hours, and do not cause brain damage). Use of ultrasound stimulation below about 50 kHz may elicit ultrasound stimulation via a conductive mechanism, but such approaches exhibit significant smearing of spectral and temporal information due to the pathway through the skull/bones to the cochlea. Consequently, exemplary implementations involve vibrating brain fluids with ultrasound using a frequency range that sufficiently passes through the skull to induce vibrations of brain fluids and, consequently, vibrations of fluids of the cochlea (which stimulates the auditory system). Vibration of fluids in the cochlea through this pathway may achieve a direct and systematic vibration of cochlear fluids that can mimic the vibration of cochlear fluids that occurs when sound is naturally transmitted through the ear drum to the middle ear bones that then vibrate the fluids in the cochlea.

Figure 2B:
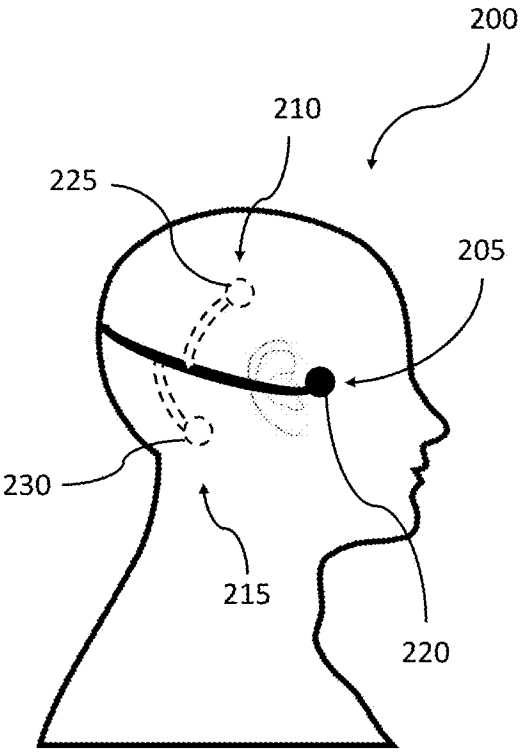
FIG. 2B is a schematic diagram of an ultrasonic hearing system according to one or more embodiments, depicting the example hearing aid device of FIG. 2A, as viewed from the side of the user's head. It is noted that the coupler can be placed on the asterion, pterion, bregma, and lambda, vibrating the cerebrospinal fluid through these ultrasound windows. The zygomatic arch, which is one of the thinnest parts of the skull, would be a window that may allow for particularly good transmission of ultrasound signals through the skull to the brain and cerebrospinal fluids (or vibration of cochlear fluids directly).
Figure 2A:
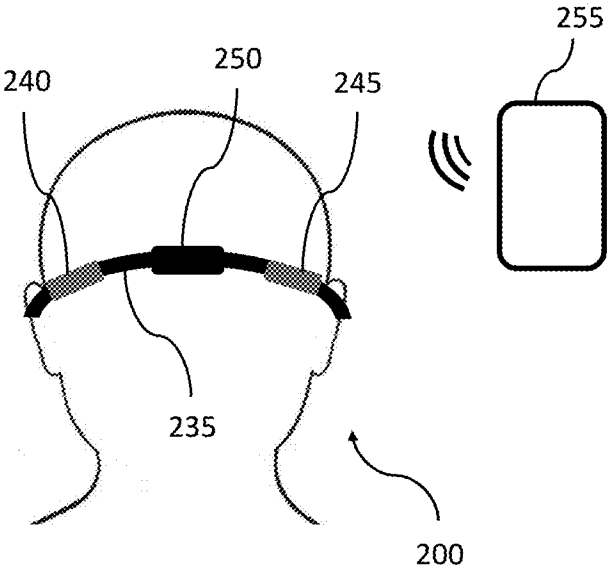
FIG. 2A is a back-view schematic diagram of an ultrasonic hearing system according to one or more embodiments, depicting an example hearing aid device with "coupler/track" on asterion, pterion, bregma, and lambda as potential ultrasound windows (i.e., locations where ultrasound signals may be delivered to the body). The system may communicate with another computing devices (such as a smartphone) to, for example, receive sounds to be delivered via ultrasound transducers. It is noted that the microphone could also be placed on the sides of the head and/or near/in the ears.

FIGS. 1, 2A, and 2B illustrate various potential configurations in different implementations of the hearing system. The hearing system is used to activate an auditory system via cerebrospinal fluids (i.e., fluids surrounding the brain and spine), and may include at least one input to capture audio signals (e.g., a microphone or a receiver that obtains audio inputs wirelessly from another device), at least one processor communicatively coupled with the at least one input, where the at least one processor extracts temporal and spectral features from the audio signal and creates modulated ultrasound signals in a range of 50 kHz to 4 MHz. The system further includes at least one ultrasonic transducer which receives the modulated signal and delivers the modulated signal to the body via a coupling/interface medium to activate the auditory system via cerebrospinal fluids. The medium, which can be one or more of air, gel, gel sac, gel pad, gel-filled or fluid-filled tube, or solid flexible tube, provides an interface between the transducer and the body. In one example, a contained sac or pad is directly coupled to a transducer tip and is pushed up against, or stuck to, a body region.

FIG. 1 illustrates an example implementation with a single wearable ultrasound transducer device 100. The transducer device 100, which includes transducer 110, can be mounted or otherwise secured to the body (e.g. skin) 120 using an interface medium 130 (such as a coupling gel or sticky pads) that makes close contact with the body (e.g. skin) 120. An adhesive or bonding agent on the interface medium 130 may be used to help secure the transducer device 100 in place and maintain contact with the body (e.g. skin) 120 (such that, in certain embodiments, a separate component for pressing the transducer against the ear or head region is preferably not necessary due to the presence of the adhesive or bonding agent). A components segment 140 may include, for example, a receiver for wirelessly receiving captured sounds (e.g. from a remotely-located microphone and/or a microphone for capturing sounds directly), control circuitry with a processor for processing received/captured sounds and controlling the components of the transducer device 100, and a source of energy such as a battery. Pressure (ultrasound) waves may be delivered into the body 120 via interface medium 130. It is noted that in a wearable earphone-like ultrasound hearing system, the transducer may be optionally disposed within an ear canal. Because it can be disposed snugly within the ear canal in such implementations (see, e.g., FIGS. 2C and 2D), an adhesive or bonding agent may not be necessary.

Ultrasonic transducers can be positioned on different parts of the body, such as the skull, chest, back, and/or stomach. In different implementations a carrier may be located around a user's neck, positioning at least one microphone near the chest. There may be, for example, left and right microphones and left and right transducers along the user's neck. As the transducers deliver signals to the user through the neck, the signals reach spinal and brain fluids and travel to the cochlear fluids and activate the auditory system. Different transducers can be specified for certain frequency ranges to better attune the system for the user, as further discussed below. Transducers may be secured to flexible arms, allowing the transducers to be positioned and repositioned to different portions of the user's back/body to better suit different users. Certain portions of an individual's body may be better suited for allowing ultrasound signals to travel to the auditory system than other portions, and/or they may be more comfortable for the user. In still other embodiments, one or more transducers may be coupled with a halo or headband that is placed on the user's head (around the forehead, for example). For example, multiple transducers can be used around the perimeter of the head, positioned on the forehead, and/or positioned along the side of the head. An array of transducers, each of which optionally may be used to receive the modulated signal within a predefined frequency range, may also be used. The ultrasonic transducers receive a modulated signal and deliver the modulated signal to at least one medium to activate the auditory system via cerebrospinal fluids.

FIGS. 2A and 2B illustrate placement of one or more couplers 205, 210, 215 for an example system 200. The couplers are connected with one or more transducers 220, 225, 230 of the system, as discussed above. The couplers 205, 210, 215 may be coupled directly with the transducers 220, 225, 230 (as shown) or indirectly with the transducers. For example, for indirect coupling a flexible track 235 filled with a coupling medium may be connected between the transducer and the coupler. The track 235 can serve as a mounting structure, to mount on a user, such as around the head. The track 235 can also be used to position the couplers 205, 210, 215 and/or transducers 220, 225, 230 along certain parts of the head, such as, but not limited to, one or more of the asterion, pterion, bregma, lambda, or zygomatic arch, which have effective transmission through the skull to brain fluid. As discussed above, the system may include microphones 240, 245 (and/or other inputs, such as a wireless receiver), and a controlling circuit/processor and battery unit 250. Optionally, a computing device 255 (such as a mobile device like a smartphone, tablet, laptop, and the like) can wirelessly (or otherwise) communicate with controlling circuit 250 to allow system 200, for example, to receive sounds (such as the spoken words of a person with whom the user is speaking using their phones, or pre-recorded speech or other sounds) to be transduced to the user. It is noted that in certain implementations, some or all of the processing involved in generating the ultrasounds to be transduced may be performed by computing device 255.

Figure 2D:
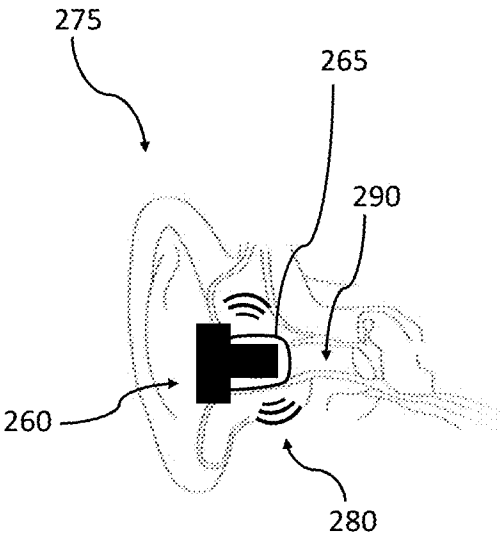
FIG. 2D is a schematic diagram depicting ultrasonic pressure waves from the transducer of FIG. 2C traveling through the skin and skull to the cerebrospinal fluids, according to one or more embodiments. It is noted that the transducers can also be positioned on other parts of the body, such as the ear canal, neck, back and stomach.
Figure 2C:
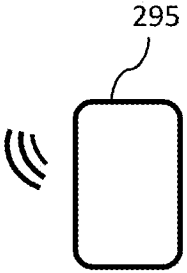
FIG. 2C is a schematic diagram of an ultrasonic hearing system according to one or more embodiments, depicting an example wearable earphone-like ultrasound hearing aid device. The interface medium (such as a coupling gel, pad, etc.) need not be a sticky pad if the transducer snugly fits in the ear canal pushed up against the inside portion of the ear canal.
Figure 2C:
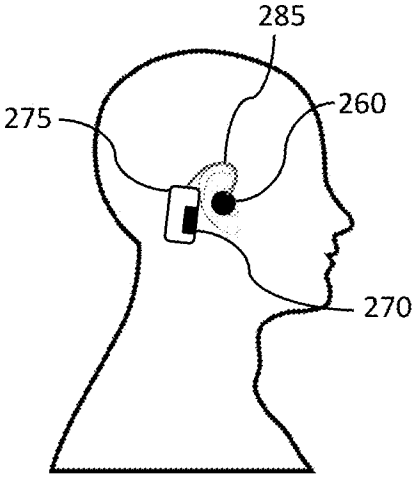

FIGS. 2C and 2D illustrate a wearable earphone-like ultrasound hearing system. The transducer 260 is optionally disposed within the ear canal 290. In one or more potential implementations, the interface medium includes a coupling gel and/or a pad 265. Because it can be disposed snugly within the ear canal 290, an adhesive or bonding agent may not be necessary. FIG. 2C illustrates how the microphone 270 and battery and processor segment 275 (which may include, for example, control circuitry with a processor, as well as a wireless receiver and a source of energy such as a battery) are disposed near the transducer 260, and can be positioned behind the ear 275. The transducer 260 and processor segment 275 may be electrically/communicatively coupled via connector 285. Optionally, a computing device 295 (such as a mobile device like a smartphone, tablet, laptop, and the like) can wirelessly (or otherwise) communicate with the device to, for example, receive sounds (such as the spoken words of a person with whom the user is speaking using their phones, or pre-recorded speech or other sounds) to be transduced to the user. As depicted in FIG. 2D, pressure (sound) waves 280 may be delivered into the skull via medium 265.

As mentioned above, the ultrasound hearing system may be used to activate an auditory system using cerebrospinal fluids, where the system includes at least one input (e.g., a sound sensor such as one or more microphones capable of capturing ambient sounds, a receiver for receiving live or pre-recorded audio from another device such as a mobile phone, and/or a connection with a co-located memory that stores audio files and is accessible to the processor). At least one processor is communicatively coupled with the at least one input, where the at least one processor extracts temporal and spectral features from the audio signal and creates modulated ultrasound signals in a range of 50 kHz to 4 MHz. In one or more embodiments, the modulated range includes 20 Hertz (Hz) to 20 kHz and it can be any complex waveform within this range that is used to modulate very high carrier ultrasonic frequency or frequencies for different head/ear/body regions. In one or more embodiments, 20 Hz to 20 kHz modulation frequencies and temporal fluctuations are used to modulate the 50 kHz to 4 MHz carrier ultrasonic frequencies. For example, the recorded sound (being recorded in real-time or previously-recorded and received) can be bandpass filtered from 50 Hz to 12 kHz or from 500 Hz to 5 kHz (or the full audible range of 20 Hz to 20 kHz, if needed) to obtain a filtered signal. The filtered signal/waveform is used to modulate the ultrasonic carrier frequency (which can be, for example, 1 MHz or 100 kHz or multiple such high carrier frequencies or a continuous bandwidth of high carrier frequencies). In various implementations, different carrier frequencies can be used for different locations on the body, e.g., 1 MHz carrier signals may be used when ultrasound is to be delivered to areas of the skull, and 100 kHz for chest areas. Both locations can be stimulated at the same time in which both carriers are modulated with, for example, 50 Hz-12 kHz (or 20 Hz to 20 kHz) modulation.

FIGS. 3-8 illustrate systems and methods for implementing the disclosed ultrasonic hearing system. In one or more embodiments, a method to activate an auditory system using cerebrospinal fluids includes receiving a sound signal to be perceived by a user, such as by capturing audio signals with an input device or a wireless receiver from another device. The sound/audio signal may then be processed with at least one processor and ultrasound signals (modulated using frequency-transposed sound recordings) generated in a range of 50 kHz to 4 MHz. The method further includes sending the modulated ultrasound signals to at least one transducer, and delivering the ultrasound modulated signals to a medium with the at least one ultrasonic transducer.

Several options for the methods are as follows. For instance, in one or more embodiments, processing the audio signals and creating ultrasound modulated signals with carrier signals occurs in a range of, for example, 100 kHz-1 MHz. In a further option, the method further includes filtering the audio signals with at least one bandpass filter and creating at least one filtered signal, and further optionally each filtered signal is amplified and compressed to compensate for frequency-specific deficits, and/or further comprising reconstructing each filtered signal to a time-domain, and optionally using the time-domain signal to modulate the ultrasound carrier signal that is between 100 kHz to 1 MHz or 50 kHz to 4 MHz. In one or more embodiments, the ultrasound carrier is one frequency or multiple frequencies between 100 kHz-1 MHz or 50 kHz to 4 MHz. In one or more embodiments, sending modulated signals to at least one transducer includes sending modulated ultrasound signals to an array of ultrasonic transducers each having a pre-determined frequency range.

In one or more embodiments, the modulated range includes 20 Hz to 20 kHz and it can be any complex waveform within this range that is used to modulate very high carrier ultrasonic frequency or frequencies for different head/ear/body regions. In one or more embodiments, 20 Hz to 20 kHz modulation frequencies and temporal fluctuations are used to modulate the 50 kHz to 4 MHz (or 100 kHz to 4 MHz, 100 kHz to 1 MHz, etc.) carrier ultrasonic frequencies. For example, the recorded/desired sound signal can be bandpass filtered from 50 Hz to 12 kHz (or the full audible range of 20 Hz to 20 kHz, if desired) to obtain the filtered signal. The filtered waveform may be used to modulate the ultrasonic carrier frequency (which can be 1 MHz or 100 kHz or multiple of these high carrier frequencies) or a continuous range of ultrasonic carrier frequencies (e.g., all frequencies between 100 kHz to 200 kHz or 500 kHz to 1 MHz, etc.). Different carrier frequencies can be used for different locations on the body, e.g., 1 MHz for skull area and 100 kHz for chest area. Both locations can be stimulated at the same time in which both carriers are modulated with 50 Hz to 12 kHz modulation.

Figure 3:
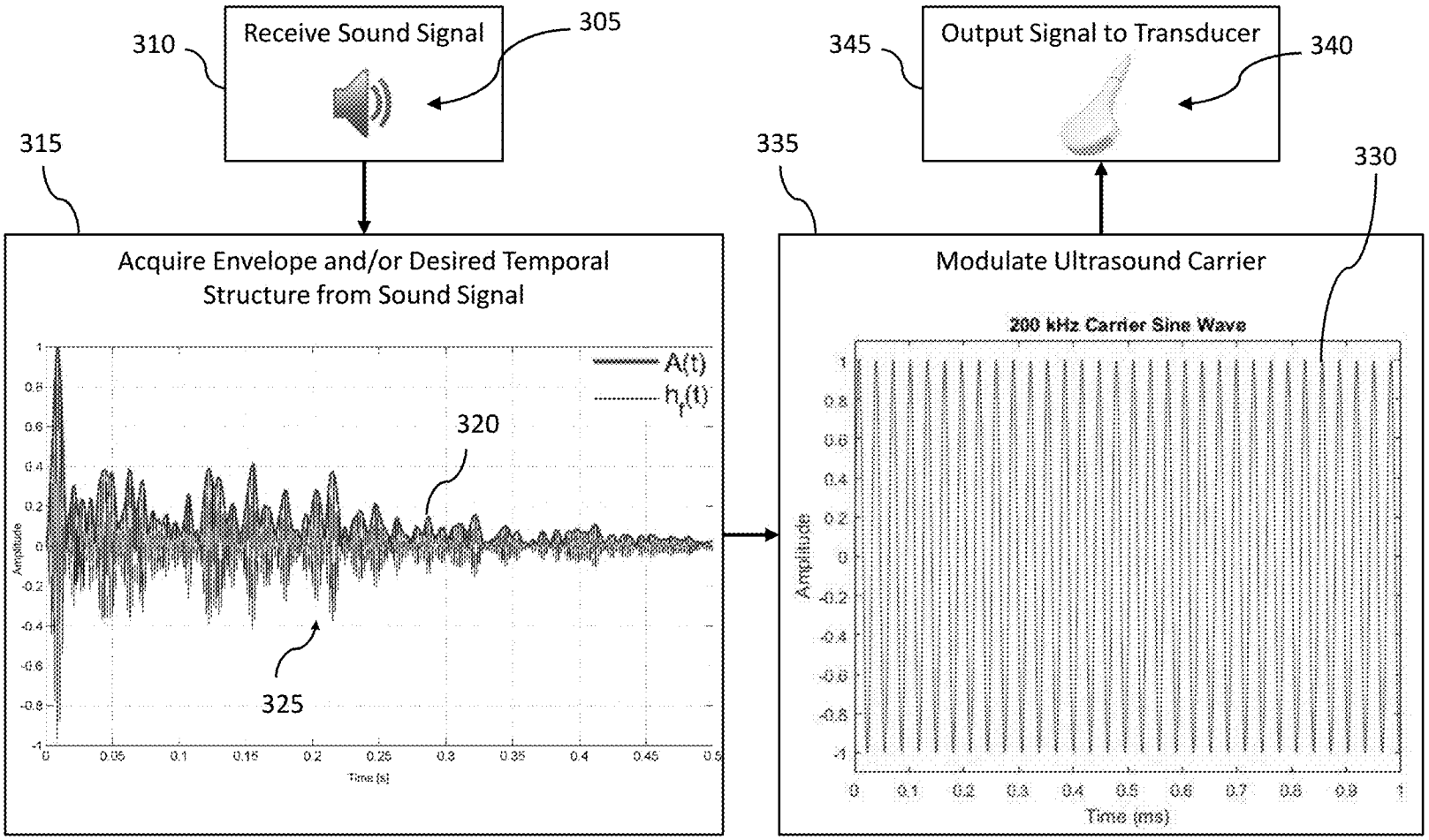
FIG. 3 is a flowchart of an example system and related method, illustrating steps involved in the delivery of desired sounds via modulated ultrasonic stimulation.

In one or more embodiments, as depicted in FIG. 3, an auditory signal may be received or captured, for example, by an input such as a microphone 305 (block 310). An envelope or fast temporal structure may be obtained from the auditory signal (block 315), for example using a processor. The envelope 320 (e.g., the line connecting the upper tips of the auditory signal 325) or other temporal features of the auditory signal 325 may be extracted and used to modulate the ultrasound carrier signal 330 (block 335). The modulated carrier signal is then sent to the transducer 340 (block 345). The transducer 340 is used to deliver the ultrasonic signal to the user. Before the ultrasound carrier is modulated, the signal may be preprocessed to target edge regions of the cochlea, as further discussed below.

Figure 4:
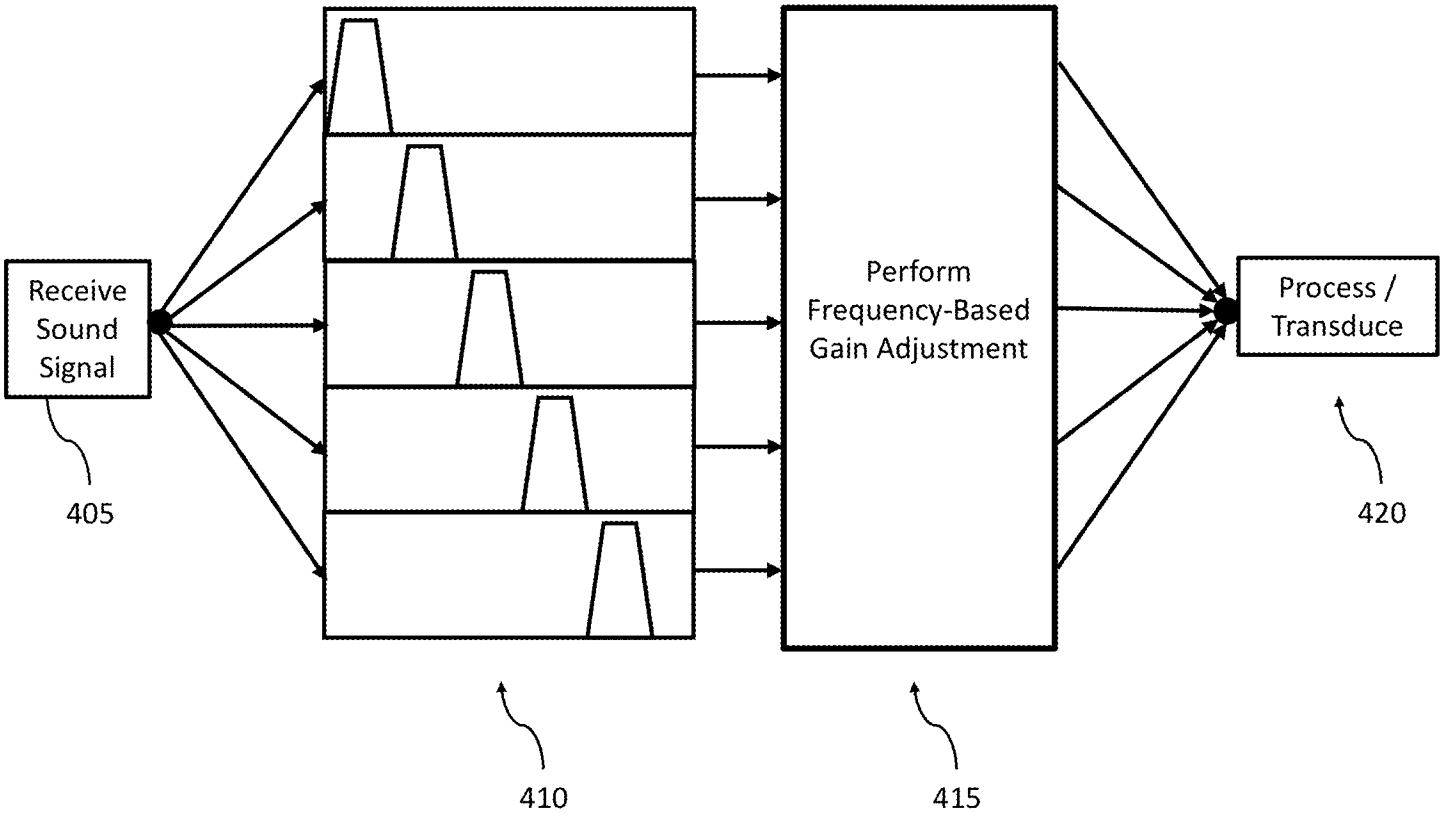
FIG. 4 is a flowchart of another example system and related method according to one or more embodiments, with frequency-based gain adjustment. An audio signal may be split up into frequency bands using bandpass filters. This allows for individual gain adjustment based on frequency bands, such as frequency bands with corresponding structures that may be damaged in a given patient (i.e., frequency bands for which a patient has a hearing deficit) or frequency bands having interference from other ambient sound components that requires compensation for better hearing of desired sound components. The signals can then be reconstructed, preprocessed, transposed, and used to modulate a carrier signal when delivered to the body using the transducer. Such a modified process could ensure that the ultrasonic stimulus is loud enough and adjusted to be heard as expected for natural audible sound stimulus before further processing and delivery of ultrasound stimuli.
Figure 5:
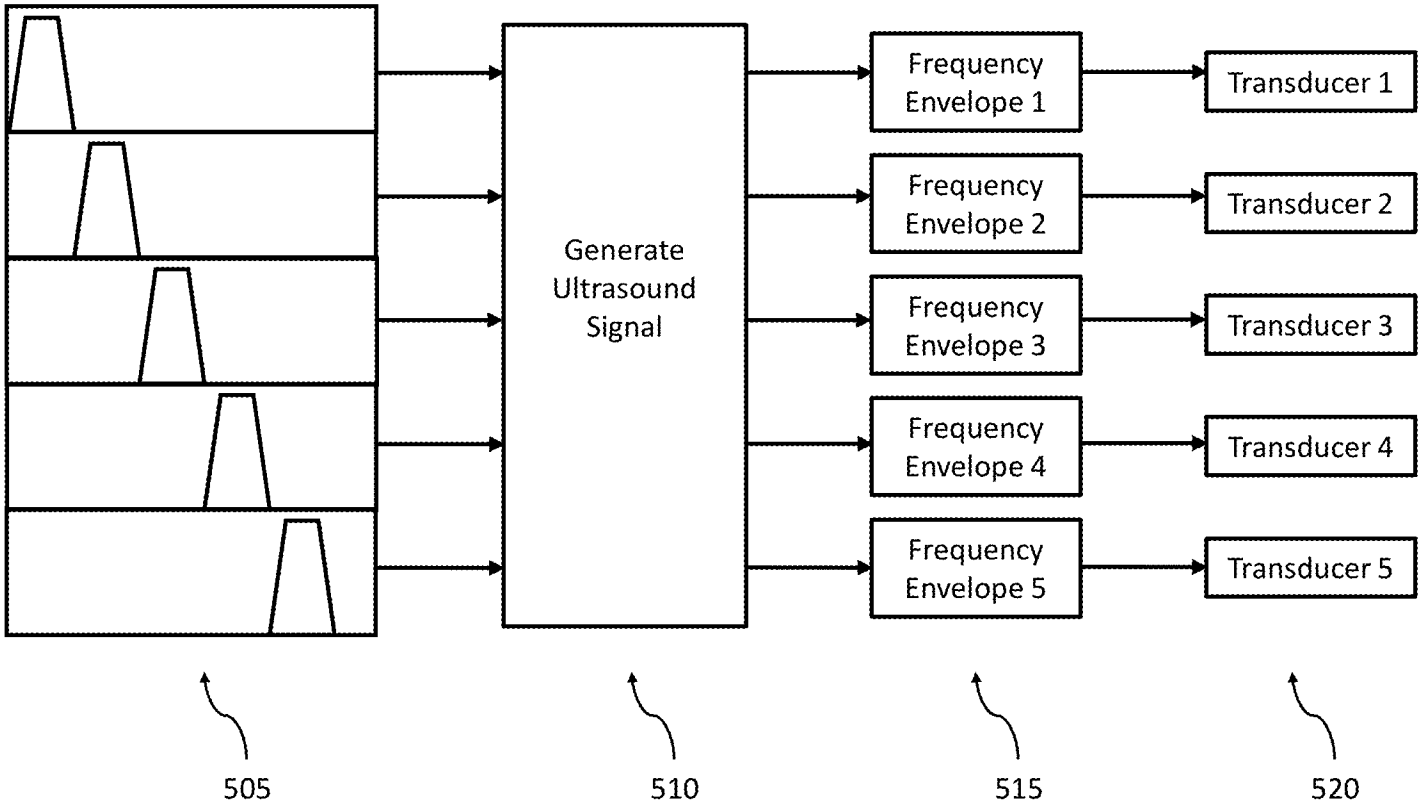
FIG. 5 is a flowchart of another example system and related method according to one or more embodiments, with different transducers selected/specified for different frequency bands. An array of transducers may be used, and the ultrasound signal may be split up into frequency bands, with each frequency band presented to the wearer via a separate transducer. Such a process can further individualize and customize based on frequency. This type of system could also enable beamforming in which the magnitude, phases and delays of the ultrasonic signals are appropriately adjusted across transducers so that the energy cancels out at locations other than a target or local region in the brain or cochlea to directly vibrate the fluids in that localized region.

In one or more embodiments, as shown in FIG. 4, after the sound signal is received (405), the method includes splitting the audio signal into frequency bands using one or more bandpass filters (410). This allows for gain adjustments (to adjust relative energy or volume) based on frequency bands (415). The signals can then be reconstructed and further processed (as discussed below) before being used to modulate the carrier signal to be provided to the transducer. FIG. 5 illustrates the use of one or more transducers, such as an array of transducers, corresponding with different frequency envelopes. As above, after an audio signal is received, the audio signal may be split up into frequency bands (505). The frequency bands may be processed (510), and a set of frequency envelopes may be generated to correspond with the different modulation frequency bands (515). That is, the audio signal can be bandpass filtered into different pre-determined frequency ranges for different transducers in which those frequency ranges are sub-ranges between 20 Hz to 20 kHz. These modulation signals are used to modulate (for example, multiply with) the ultrasonic carrier frequency (e.g. to produce amplitude modulation of the carrier signal), selected from between 50 kHz to 4 MHz, for a given transducer. Each frequency band may be presented to the user via separate transducers (520). It is possible to present several carrier frequencies at the same time that are modulated by one of these pre-determined modulation signals, or present just one carrier frequency to each transducer that is modulated by one of these pre-determined modulation signals in which there are multiple transducers to span all of the pre-determined modulation frequency ranges.

Examples of the ultrasound hearing device described above are well-suited for individuals with hearing loss, but the ultrasound device can also be used with similar device components to provide different or enhanced hearing for those without any noticeable hearing loss. For example, the device could be used to listen to speech or music in a noisy environment that compromises normal hearing in various situations. Furthermore, the ultrasound hearing device could be used in consumer products such as cell phones, smartphones, music players, recorders or other devices in which sound is transmitted to the user. The sound information may be information that has already been recorded on the device or it may be transmitted to the device through a wired or wireless interface from another device that has a microphone sensing the sound signal elsewhere. The various algorithms described above can be used to enhance or improve the sound quality of specific temporal or spectral components in the desired acoustic signal that have experienced interference or distortion from the ambient or recorded environment. To allow users to hear sounds in different perceptual channels, the sound can be transposed as discussed below.

This transposed signal can also be used to treat conditions such as tinnitus by targeting and stimulating a specific cochlear region that is not sufficiently activated through the normal hearing pathway, and thus reverse hearing loss effects in that cochlear region that led to the condition (e.g. tinnitus perception).

Figure 6:
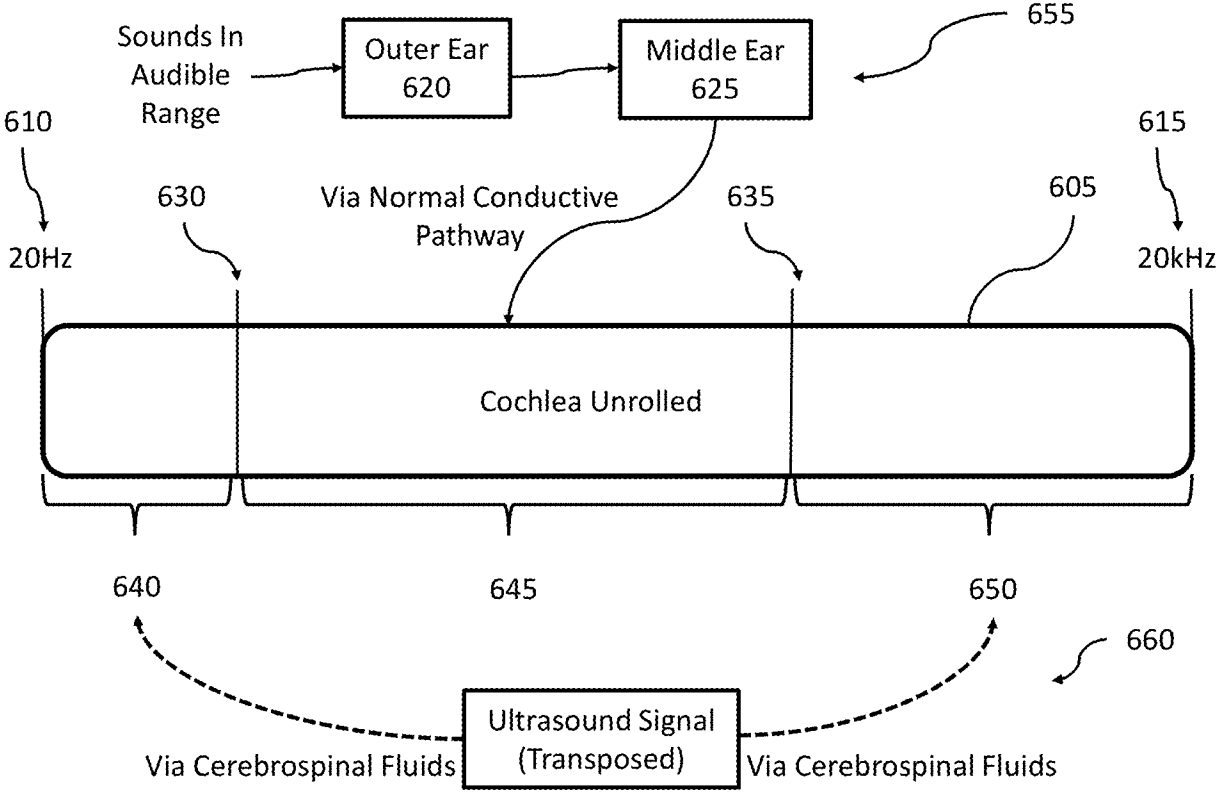
FIG. 6 is a representation of the cochlea (rolled out), illustrating that different regions of the cochlea are tuned to different frequencies. The conventional conductive pathway more readily activates a mid-region of the cochlea corresponding to middle frequencies (e.g., due to the filtering characteristics of the outer and middle ear pathway), whereas systems and methods target "edge portions" of the cochlea corresponding to frequencies on the lower and upper ends (in the range of audible frequencies) that are unused or underused. It is noted that the middle portion of the cochlea could also be targeted as needed for appropriate sound transmission.

Referring to FIG. 6, the cochlea 605 (illustrated in an unrolled state) in humans can span a frequency range in tens of hertz 610 (e.g. as low as about 20 Hz) up to beyond 15 kHz 615 (e.g. as high as around 20 kHz). The outer ear 620 (the ear canal and ear drum), and middle ear 625 (middle ear bones) limit what frequencies reach the cochlea 605 via the normal conductive pathway 655. In other words, the outer and middle ear parts 620, 625 amplify certain frequencies and attenuate other frequencies, particularly attenuating the lowest (below low cutoff frequency 630, such as 250 Hz) and highest frequency components (above high cutoff frequency 635, such as 8 kHz). This lack of activation of particular cochlear regions may be even worse if there is damage caused to the outer and middle ear pathways, which is common in a large population of hearing loss patients, and a lack of cochlear activation can lead to tinnitus perception. The cochlea 605 can thus be characterized by three regions based on frequency: a low frequency edge region 640, a mid-region 645, and a high frequency edge region 650. Sounds entering the outer and middle ear 620, 625 via the normal conductive pathway 655 are, in a sense, "filtered" such that frequencies between cutoffs 630 and 635 reach the mid-region 645 of the cochlea 605. Consequently, the edge regions 640 and 650 (corresponding to attenuated and filtered frequencies) of the cochlea 605 are normally unused or under-utilized. Simply using sound amplifying devices or special headphones cannot readily overcome this limitation of the ear, because sounds from such sources still travel through the outer/middle ear 620, 625, which is where the attenuation of the edge frequencies occurs. As will now be further discussed, example implementations of the disclosed systems and methods are able to bypass the normal conductive pathway 655 to activate edge regions 640 and 650 of the cochlea 605 using ultrasound signals that are able to stimulate cochlear fluids via cerebrospinal fluids.

Ultrasound stimulation is thus leveraged to bypass the attenuating outer/middle ears to directly activate different portions of the cochlea. In particular implementations, this approach directly transmits speech signals to those edge frequency regions of the cochlea. This is superior to the approach of vibrating the head/skull directly with a vibrator in order to attempt to bypass the outer/middle ears, as vibration through the skull will cause significant distortion; also, specific portions of the cochlea are not targeted because vibrating the entire head then vibrates the entire cochlea in an artificial and nonspecific manner. Vibrating the entire head/skull also vibrates the outer/middle ears. Moreover, the vibration device would create sounds that will then go airborne and reach the ear canal and cause acoustic activation of the outer/middle ears, contributing to additional noise or distortion within the normal hearing range.

A unique aspect of ultrasound stimulation is that the presented stimuli are far above the airborne/audible frequencies and would not travel through the ear canal. Instead, the ultrasound transducer interfaces with the head or face/body region via a gel or other interface medium to transmit very high ultrasonic frequencies (e.g., 100 kHz to 4 MHz range) to noninvasively reach the brain/body fluids. Those fluid vibrations then reach the cochlea through the cochlear aqueducts to vibrate fluids in the cochlea. This can specifically and locally activate different portions of the cochlea because the cochlea is being vibrated through a natural pathway, i.e. via fluid vibration. That is, the natural way to stimulate the auditory nerve is to use the middle ear bones to vibrate a membrane on the cochlea that then vibrates the fluid in the cochlea, and the ultrasound signals being transduced here also vibrate the fluid directly through a natural brain-to-cochlear aqueduct/connection. (This is in contrast to simply shaking the head/skull to then shake/vibrate the entire cochlea in a distorted and unnatural way to vibrate the fluid within the cochlea.)

An ultrasonic carrier is thus modulated such that the signal reaches only a specific portion of the cochlea, particularly the edge portions of the cochlea that are being under-utilized, to transmit, for example, speech stimuli. The airborne noise coming through the ear canal or skull/head vibrations from the surrounding environment will mainly activate the middle portion of the cochlea. Consequently, using such ultrasound stimulation, the approach in a sense "multiplexes" the cochlea to send a desired speech signal (or other sound) to the non-used or under-used edge regions of the cochlea so that the person hears both the noise and speech in separate perceptual channels. The user perceiving both can focus on the speech signal, which would not be masked by the noise because it is not activating the same portion of the cochlea. It is noted that the speech (or other sound) received at the high-frequency edge region of the cochlea could be perceived to have a higher pitch (or a low pitch if received at the low-frequency edge portion) because of where the cochlea is being activated, but the speech would still be understandable. It is also noted that, because it may be desired to achieve at least tens of hertz up to hundreds of hertz of modulation for enhanced speech understanding, it may not be as effective to activate the low frequency edge portion of the cochlea with this extra speech channel. That is, due to some aliasing effects, the low frequency edge portion would correspond to frequencies of tens of hertz to hundreds of hertz so that edge region of the cochlea may not be able to fully keep up perceptually with hundreds of hertz of modulation. Consequently, it is preferable to use the higher frequency region of the cochlea, spanning frequencies of, for example, 6 kHz to 15 kHz, to carry that supplemental speech (or other sound) channel.

In example implementations of the "multiplexing" approach, a single ultrasound frequency (such as 100 kHz) may be used as the carrier, although in other implementations, multiple carrier frequencies or a continuous bandwidth of carrier frequencies may be used. The carrier may be modulated by, for example, a 12 kHz sinusoid corresponding with a sound to be perceived. This would be expected to cause activation of the 12 kHz region of the cochlea. The envelope of the desired speech signal can be extracted, up to, for example, 500 Hz frequency components. A half-wave rectification of the envelope signal may be performed, as well as low-pass filtering of the rectified-envelope signal to smooth out the signal and minimize or otherwise reduce spectral splatter. This rectified envelope signal may be multiplied with the 12 kHz modulated-100 kHz ultrasound signal. When this ultrasound signal is presented to the head/body, the 100 kHz ultrasound carrier gets the signal noninvasively into the brain/body fluids, and the 12 kHz modulation gets the signal to the 12 kHz region of the cochlea. The cochlea performs in a first order approximation a half-wave rectification and low-pass filtering (many models and experiments have demonstrated this processing property of the cochlea in mammals), which is what was done to pre-process this ultrasound signal for the envelope component. As a result, what the cochlear hair cells and nerve fibers finally see is the speech envelope it would see in the normal cochlear frequency regions, but instead transposed to the 12 kHz cochlear region. So this would result in speech that is understandable but may sound high pitched (e.g., "chipmunk-like" speech), with a major advantage that it is not masked or covered by the surrounding noisy environment sounds that travel through the ear and to the cochlea in those middle cochlear regions (e.g., mostly in 250 Hz to 8 kHz regions).

To provide a fuller speech perception experience, the 100 kHz ultrasonic carrier may be modulated with a range of frequencies from, say, 6 kHz to 15 kHz, to span a larger portion of the cochlea. The half-rectified speech envelope may then be applied to that broader-band stimulus. The rationale for such an approach is, because speech would typically be transmitted through a range of frequency locations along the cochlea (e.g., 500 Hz to 5 kHz portions of the cochlea), it may be desirable to transpose that wider range to a comparably wide or wider range of locations in the higher frequency end of the cochlea.

Figure 7:
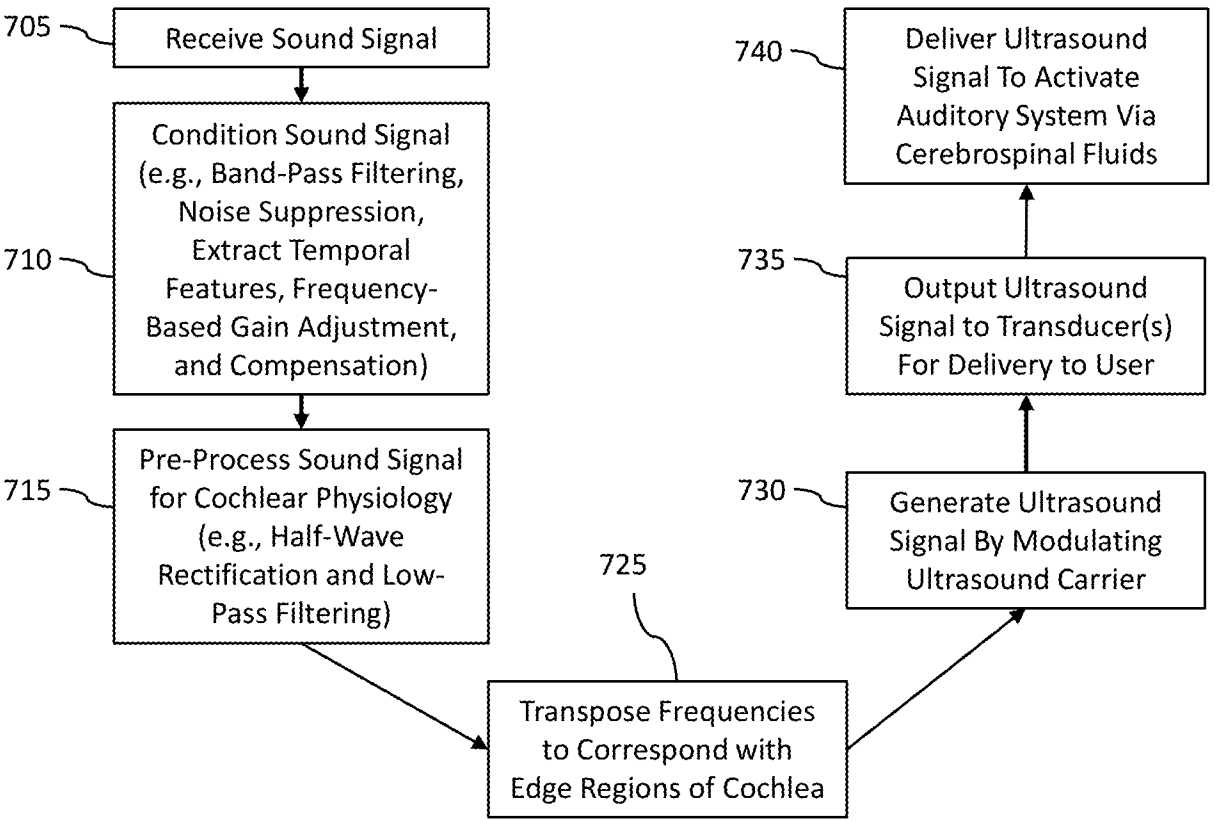
FIG. 7 is a flowchart of an example system and related method according to one or more embodiments, in which sounds are processed to generate a transposed ultrasound signal that targets the edge portions of the cochlea.

Referring to the example process depicted in FIG. 7, a sound signal (such as speech) may be received using a wireless receiver (705), or may be captured using a sound sensor or other means. To prepare the sound signal, it may be processed ("conditioned") by applying, for example, band-pass filtering, noise suppression, extraction of temporal features, compensation, and gain adjustment for loudness (710), as discussed. The gain adjustment may be frequency-based, such that more desirable frequencies are magnified to a greater extent than less desirable frequencies. The signal may then be pre-processed, such as by applying a half-wave rectification and low-pass filtering, as discussed (715). To target an edge portion of the cochlea, the sound signal may have its frequencies transposed to the target frequency range (725). This may be accomplished by, for example, multiplying the signal by the target range of frequencies (such as 6 kHz to 15 kHz). An alternative transposition approach would be to convert the time-domain signal into a frequency-domain signal (using Fourier analysis), shift the signals to the target range, and convert the signal back into the time domain. To transform the sound signal into the ultrasound domain (730), the sound signal may then be multiplied by the ultrasound carrier signal. The modulated ultrasound signal can then be provided to one or more transducers (735) for delivery through the body and activation of cochlear fluids of the user (and consequently, the edge region of the user's cochlea) via cerebrospinal fluids (or directly) (740).

As suggested, many pre-processing approaches can be used (such as by varying ultrasound carrier frequencies, modulation frequencies, low-pass filtering shapes, etc.) to optimize the type and extent of speech features that reach the extra cochlear channels for each subject, as each subject may have different preferences or slightly different cochlear anatomy, such that specific algorithms need to be optimized for each user.

Figure 8:
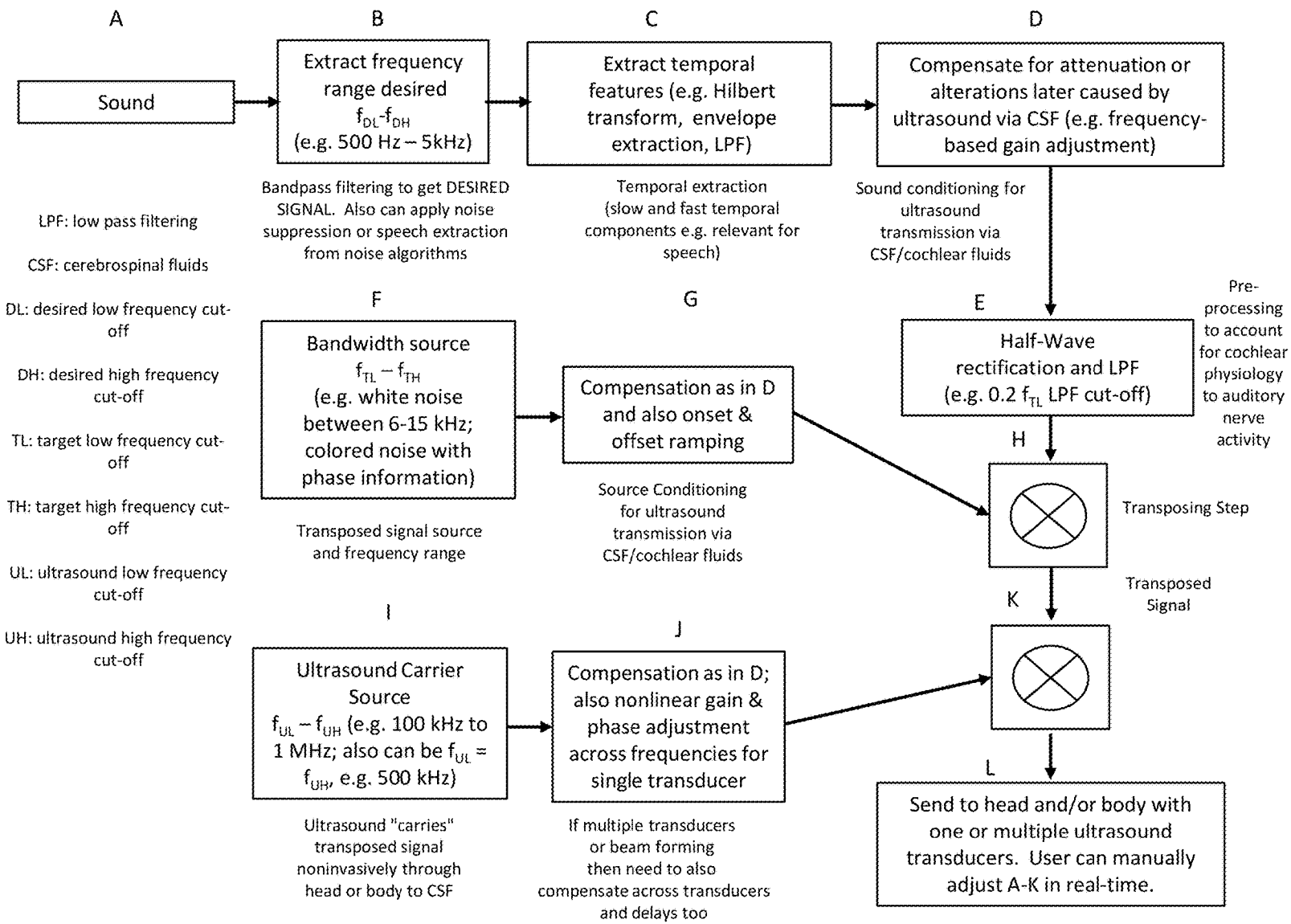
FIG. 8 is a more detailed flowchart of an example system and related method according to one or more embodiments.

A more detailed flowchart of one example implementation is depicted in FIG. 8. Sound is received in A and the appropriate spectral features are extracted in B, such as by using bandpass filtering (e.g., 500 Hz-5 kHz relevant for speech). Various algorithms to suppress recorded noise or to extract speech signals from noisy recordings can also be implemented at this stage. Then the temporal features of the signal are extracted in C, such as by using various envelope extraction algorithms, Hilbert Transform, or low pass filtering. In D, sound conditioning is performed on the signal to compensate for attenuation and alteration effects that will occur to the signal when it is transmitted through the cerebrospinal fluids using ultrasound stimulation. This compensation can include frequency-specific gain adjustment as shown in FIG. 4. A critical step in this implementation is to account for the physiological processing that will be applied to the signal at the cochlea and nerve conduction to the brain. The signal will be half-wave rectified and low pass filtered (to minimize artificial spectral splatter/spreading in the signal) in E. The low pass filtering frequency cut-off will be a percentage of the lower cut-off of the target-transposed frequency range (e.g., 0.2 times the low frequency cut-off of the transposed frequency range to avoid aliasing effects). The transposition process involves multiplying the processed signal by a bandwidth source that consists of the frequencies that correspond to the target cochlear regions. The bandwidth source in F can include white noise spanning the target frequency range or colored and correlated frequency components in the target range. This bandwidth source will also preferably go through a conditioning process to adjust for alterations that will be caused to it when the transposed signal is sent through the cerebrospinal fluids using ultrasound stimulation. Finally, the transposed signal is multiplied in K by the ultrasound carrier source from I and J and sent through the head or body to vibrate the cerebrospinal fluids to the cochlear fluids for hearing activation in L. The ultrasound carrier source can be a single high frequency (e.g., 100 kHz or 500 kHz) or a continuous bandwidth or multiple discrete carrier frequencies (e.g., 100 kHz to 1 MHz). These modulated ultrasound stimuli can be sent to one transducer or multiple transducers as shown in FIG. 5, in addition to beamforming techniques to directly target specific regions of the brain fluids or cochlear fluids. The user is able, in certain implementations, to adjust these different features and algorithms in real-time through manual controllers on the hearing device or processor to improve hearing performance.

Figure 9:
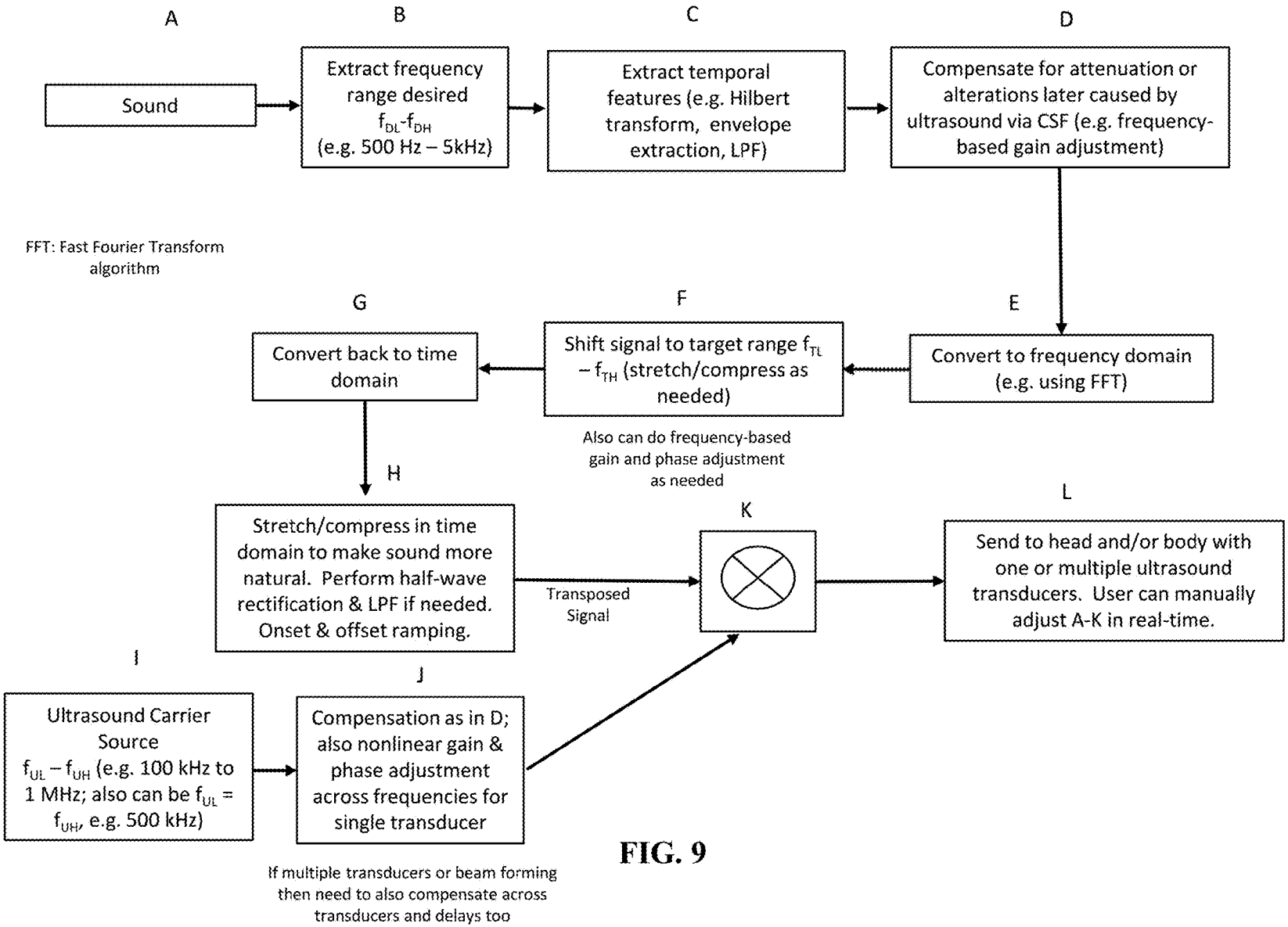
FIG. 9 provides an alternative method for transposing the signal of FIG. 8, according to one or more embodiments.

FIG. 9 shows another example method for transposing the signal shown in FIG. 8. Stages E through H of FIG. 8 can be replaced with the components shown in FIG. 9. FIG. 9 includes examples of how to transpose signals to different parts of the cochlea. The target cochlear region includes the "underused" regions, which are typically the ends of the cochlea; nevertheless, middle regions can also be used as needed. Furthermore, multiple regions can be used at the same time for one or multiple "desired signals" that are presented. The conditioned and desired signal from D is converted into the frequency domain (such as using Fast Fourier Transform (FFT)) in E and shifted into the target frequency range in F. This transposition step includes stretching or compressing different frequency components of the original signal to span the full target frequency range and for better hearing performance. The transposed signal is then converted back to time domain in G, with further processing to make the signal, such as speech, sound more natural in H. This processed transposed signal is then sent to component K shown in FIG. 8. In various embodiments, one or more of steps H and K of FIG. 8 and step K of FIG. 9 (shown by a circle-X symbol) may include other types of manipulations instead of, or in addition to, multiplication in order to obtain the "modified" carrier signal, as would be understood by those skilled in the art. In some embodiments, the transposed audio signal may be shifted by an offset quantity prior to combining with the ultrasound carrier signal, where the offset value may depend on the particular implementation. In other embodiments, each of the transposed signal and the carrier signal may be increased or decreased by a particular gain value prior to the two signals being combined. In still other embodiments, the transposed signal may be modified, e.g. by calculating the square or log of the transposed signal, in order to change the rise or fall characteristics of the transposed signal prior to combination with the carrier signal. In yet other embodiments, the combined signals can be processed in the frequency domain, for example to individually adjust the gain and/or the phases of one or more frequency components as well as spacing between components, before converting the signal back to the time domain.

Multiplexing of speech information via underused perceptual channels (i.e., using edge regions of the cochlea), while sounds are simultaneously perceived via the normal conductive pathway (using the mid-region of the cochlea) can be achieved using customized ultrasound stimuli delivered to the head/body that stimulate the cochlea via (cochlear or cerebrospinal) fluid vibrations. By using the underused portions that typically cannot be accessed by the normal hearing system through the outer/middle ears, that extra speech channel will not be masked or distorted by the surrounding noise coming through the outer/middle ear or the skull/head vibrations. This achieves a speech transmission line that can be used for clear hearing in noisy environments not currently possible for mobile phones, hearing aids, communication devices, entertainment applications, etc.

As noted, the ultrasound transducer does not need to be placed in the ear canal, but can be placed anywhere on the head or neck or elsewhere on the body. The disclosed approaches could thus be implemented using hearing aids, mobile phones, consumer products, entertainment devices, etc. without requiring an earplug or headphone device that would be placed in or over the ear. That is, example implementations provide an ear-free sound delivery system that enables additional comfort and flexibility in how sound can be delivered to the auditory system in the head.

Further, ultrasound "multiplexing" devices can be combined with a voice sensing system to enable full communication in noisy environments. Voice signals can then be digitized and processed on a wearable device to transmit the speech information wirelessly to another person wearing an ultrasound device that then presents this speech information to the other user. This setup would allow users to communicate even if they cannot hear each other in the natural way through sounds coming out of the mouth to reach the ears. Instead, the speech can be sent directly to these neck/voice sensors that then directly get transmitted to the ultrasound hearing device and through the brain/head fluids to reach the cochlea.

Figure 10:
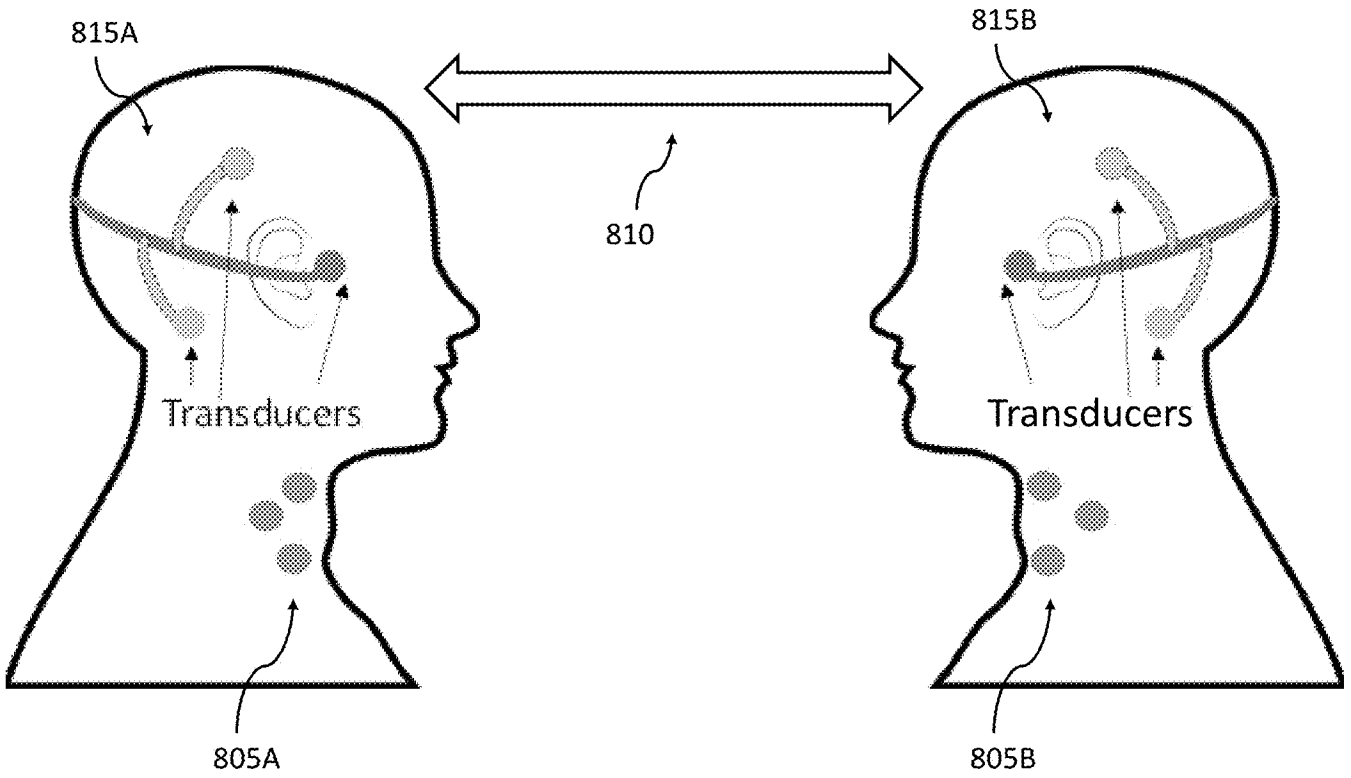
FIG. 10 depicts another example system and related method according to one or more embodiments, in which two users could speak silently (or nearly silently) even in noisy environments.

For example, with reference to FIG. 10, two users could engage in "silent" communication using input devices 805A, 805B to capture speech. Example input devices could be, for example, electromyography (EMG) recorders, vocal recorders (microphones), or other sensors placed on, for example, the neck region to pick up voice signals. The EMG/vocal recordings could be used to decode the silent speech and transmit an ultrasound signal wirelessly (via wireless communications channel 810) to an ultrasound hearing device 815A, 815B of the other user, which then delivers the ultrasound signal to the user via one or more transducers. It is noted that the input devices 805A, 805B could include transmitters for direct transmission to the ultrasound hearing devices 815A, 815B of the other user, or they could provide (wirelessly or otherwise) the recordings (pre or post processing) to the ultrasound hearing device 815A, 815B of the same user for transmission (pre or post processing) to the ultrasound hearing device 815A, 815B of the other user. The ultrasound hearing devices 815A, 815B would not be affected by noisy backgrounds because they use "extra" cochlear channels of communication (i.e., edge or other regions that are unused or underused). This approach can allow for human-to-human communication in any noisy environment.

Secret sound delivery to a person can be useful for, for example, security reasons, as others would not be able to hear what is being sent via ultrasound to a user's head. The ultrasound only becomes audible when the ultrasound is demodulated/converted in the brain fluids to the cochlear fluids. Consequently, a silent sound delivery device can be used for security applications. Additionally, such a silent delivery allows users to avoid bothering others around them. For example, when people listen to speech, audiobooks, or music with headphones at high volumes, they can be disturbing to others. Ultrasound hearing devices could avoid such disturbances.

Other example implementations/applications involve the creation of enhanced and new types of sounds and music production by combining normal sound delivery through the ears together with an ultrasound hearing device on the head/body that can reach underused cochlear regions not currently or fully accessible. New types of multi-channel sounds, music, and hearing experiences can be created for the entertainment industry.

As discussed, multiplexing sound information to different portions of the cochlea using ultrasound and fluid vibrations can avoid masking by sounds coming through the natural conductive pathway (i.e., outer/middle ear) to the cochlea. Speech (or other sounds) from multiple speakers (or other sources) can be delivered at the same time by sending the speech of each speaker to a different portion of the cochlea, so the receiving person hears all of them at the same time in different "channels." In particular, the receiving subject can customize or adjust which speaker would go to which channel, especially if the background noise is still leaking into a given channel (due to, for example, overlap in cochlear regions being used), and to put that speaker into a "less-noise" channel.

Combining this ultrasound hearing multiplexing approach with voice/neck sensors can enable full and clear communication of speech (and other sounds) in noisy environments. Ultrasound multiplexing devices and processes can be integrated into such applications and devices as mobile phones, hearing aid devices, entertainment products, hearing devices at conference/meetings (for allowing audience members to hear speakers/presenters), etc.

In other implementations, the above approach can be used as a research tool for studying the hearing system. Because the cochlea can be accessed and modulated without going through the outer/middle ear, the mechanisms and contribution of each part of the ear can be studied separately. For example, results for when test subjects are presented with sound through the ear that then reaches the cochlea can be compared with results from use of ultrasound directly to modulate the cochlea. Similarly, in clinical applications, example implementations include diagnostic tools for assessing hearing damage in patients. Currently, to evaluate damage in the outer/middle ear versus the inner ear/cochlea, a clinician performs multiple tests and compares results. Conventionally, sound is delivered to the ear to determine hearing thresholds, and a vibrator is used on the head to cause bone conduction that mostly vibrates the cochlea without going through the outer/middle ear, then the difference assessed. However, bone conduction vibrates the outer/middle ear (i.e., shaking the head in general then shakes the cochlea but also the outer/middle ear) so there are confounding effects. With ultrasound, the cochlea can be directly modulated without causing significant vibrations of the outer/middle ear. For infants, it is also difficult to use a vibration device on the head because of the discomfort caused.

In terms of treatment options, the above approach can be used to stimulate underused portions of the cochlea caused by hearing loss in which this compromised hearing has led to tinnitus perception and pain in patients. Current hearing aid technologies cannot sufficiently activate those underused portions of the cochlea due to the natural attenuation or damaged portions of the outer, middle and cochlear portions of the hearing pathway. In contrast, ultrasound stimulation can more strongly and specifically stimulate an underused portion of the cochlea to improve hair cell and nerve activation to the brain to reverse the over-compensation caused by the hearing loss and ultimately reduce or eliminate the tinnitus percept.

Example

Figure 11A:
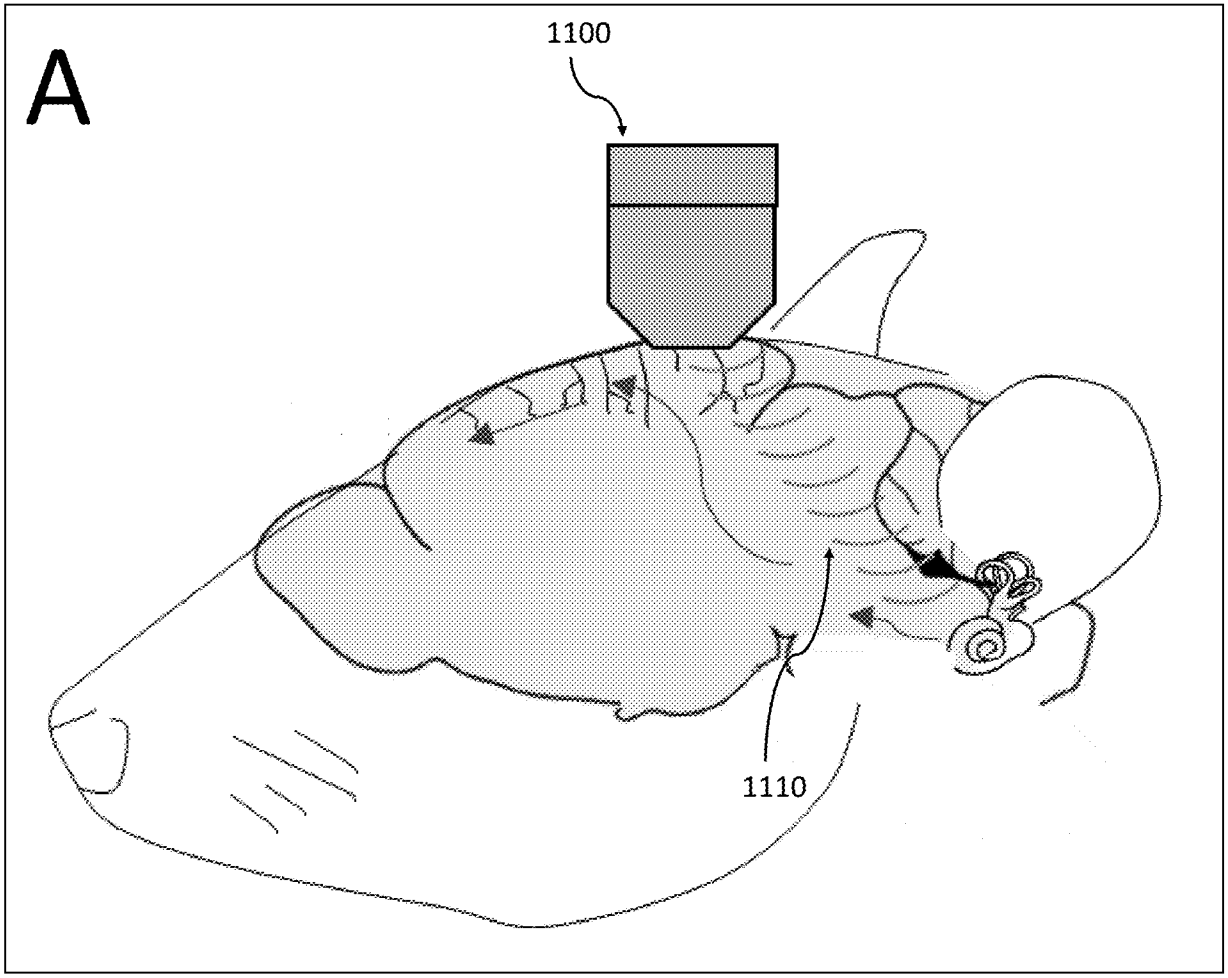
FIG. 11A shows a diagram of activation of auditory circuits in a guinea pig brain via ultrasound stimulation that is transmitted through cerebrospinal fluid and tissue in the head to vibrate the cochlear fluid.

Ultrasound (US) stimulation may activate auditory circuits through peripheral structures, for example through vibrations of the cerebrospinal and cochlear fluid (FIG. 11A). As shown in this Example, amplitude-modulated ultrasound can selectively activate different neuronal populations depending on the modulating frequency. The selectivity of activation follows a consistent trend as would be expected for frequency-specific or tonotopic activation of the ICC.

FIGS. 11A-11G show amplitude modulation of ultrasound pulses which lead to safe and selective activation of neural populations in auditory structures of guinea pigs. A transducer 1100 emits ultrasound waveforms 1110 with a high center frequency (FIG. 11A) and the carrier waveform may be modulated using frequencies in the audible-hearing range. Without being limited as to theory, it is hypothesized that the pressure waves undergo non-linear demodulation, allowing for the perception of the envelope signal. Experiments were performed which tested various envelope signals carried by ultrasonic frequencies to observe the selectivity of the responses in the central nucleus of the inferior colliculus (ICC), which is a midbrain structure in the central auditory pathway with high specificity in frequency tuning. Histological analyses of various ultrasound parameters were also conducted to assess the safety of ultrasound stimulation.

Figure 11B:
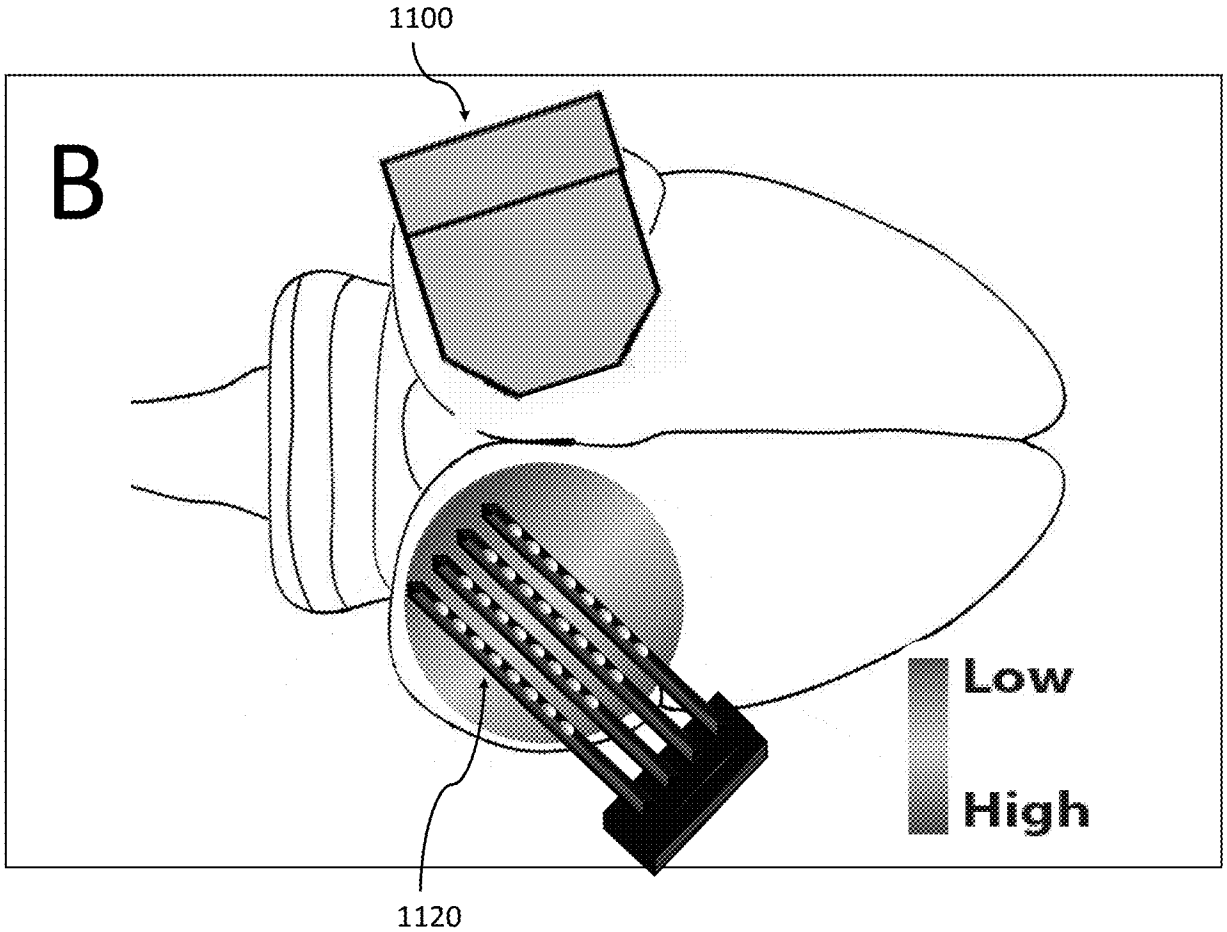
FIG. 11B shows placement of a transducer over the caudal-lateral region of the left hemisphere of a guinea pig and recording of signals from the brain with a recording electrode array device.
Figure 11C:
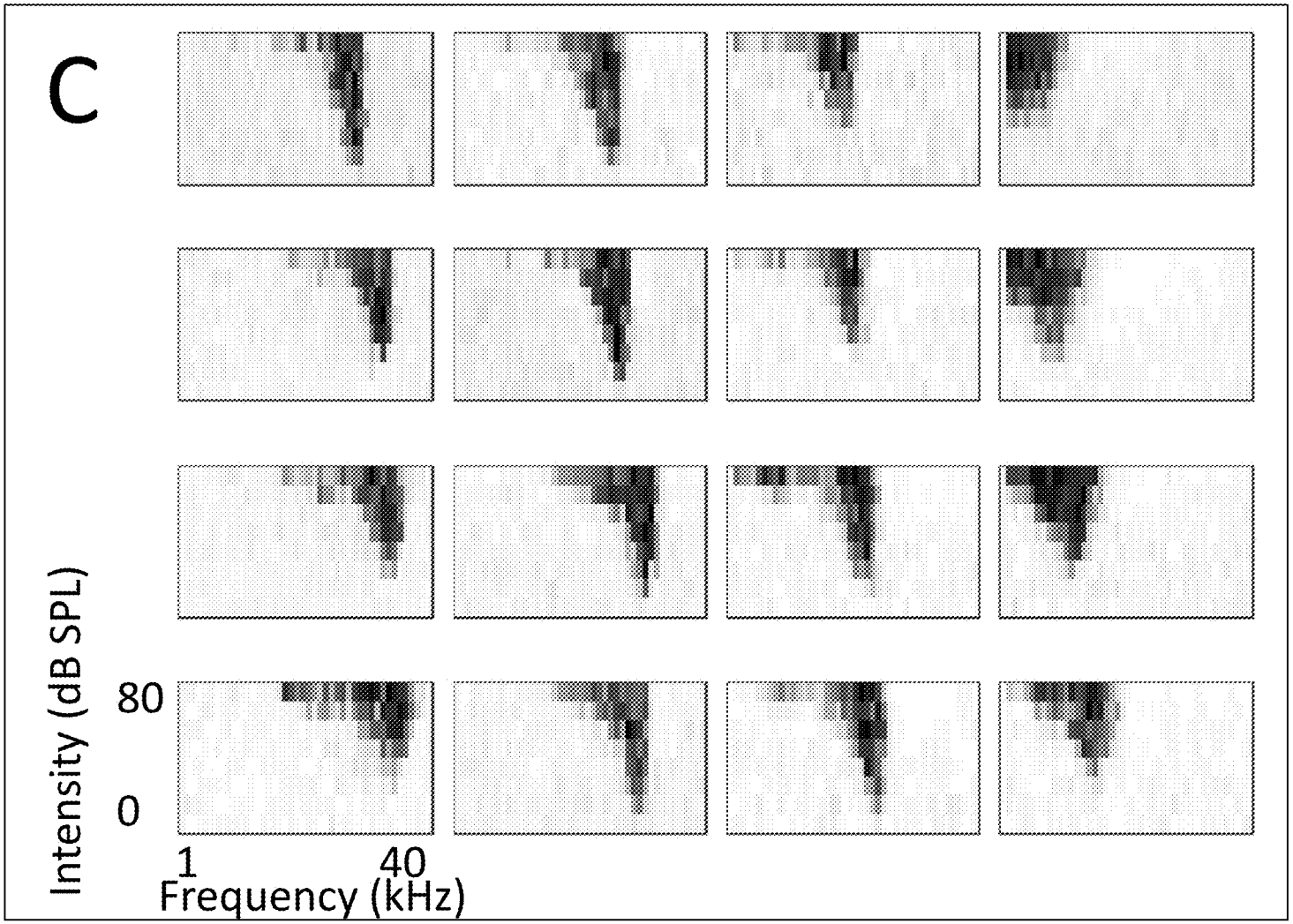
FIG. 11C shows tuning curves obtained from presentation of single-tone acoustic stimuli (1-43 kHz, 0-70 dB) followed by quantification of the spiking activity.

Recordings were obtained from the right ICC of ketamine-anesthetized guinea pigs (350-520 g) using 2-shank, 32-site electrode arrays 1120 (NeuroNexus Technologies) following previously-detailed surgical procedures (Markovitz et al., "Tonotopic and localized pathways from primary auditory cortex to the central nucleus of the inferior colliculus," Front. Neural Circuits, Vol. 7, 25 Apr. 2013, which is incorporated herein by reference in its entirety). To ensure that the electrodes were in the ICC, broadband noise (50 ms, 70 dB-SPL) was presented for 100 trials (1/500 ms) and Post-Stimulus Time Histograms (PSTHs) of the driven spiking activity were developed. The transducer 1100 (Sonic Concepts) was placed in a focusing cone with degassed water and coupled over the caudal-lateral region of the left hemisphere via agarose (FIG. 11B). This positioning allowed for stimulation of the contralateral cochlea which provides input to the right ICC. A function generator (Keysight Technologies) was used to deliver custom stimulation waveforms to the transducer. Each stimulus (50 ms) included a center frequency (220 kHz) modulated by particular envelope frequencies (including: 1.3, 2, 3, 4, 5, 7, 10, 12, 16, 21, 25, 32, 38 kHz) and each pair of center-envelope frequencies was presented for 100 trials to develop PSTHs at different pressures (5-15 kPa). To ensure the transducer was not emitting an air-conducted stimulus, it was decoupled from the brain and a control trial was performed. To identify the characteristic frequency of each channel, single-tone acoustic stimuli (1-43 kHz, 0-70 dB) were presented and the spiking activity was quantified to develop tuning curves (examples shown in FIG. 11C). To assess the safety of ultrasound, isoflurane-anesthetized guinea pigs were chronically stimulated for a total of 25 hours, spread evenly over five sessions, modifying a single ultrasound parameter setting (pressure 100-800 kPa, duty cycle 5-80%, or sonication duration 0.05-9.6 s). The transducer output and temperature were measured constantly throughout the experiment to ensure that no damage or change occurred which affected the output. For half of the total time, a low frequency modulation (0.5 kHz) was used, and a high frequency modulation (3 kHz) was used for the other half. A day after the last session, the guinea pigs underwent perfusion surgeries while anesthetized with ketamine. Brains were removed and fixed in paraformaldehyde for an additional two weeks before being embedded in paraffin wax. Sections were cut at 5 microns and stained with H&E. The slides were then imaged and analyzed for damage.

Ultrasound-Induced Activity of ICC

Figure 11D:
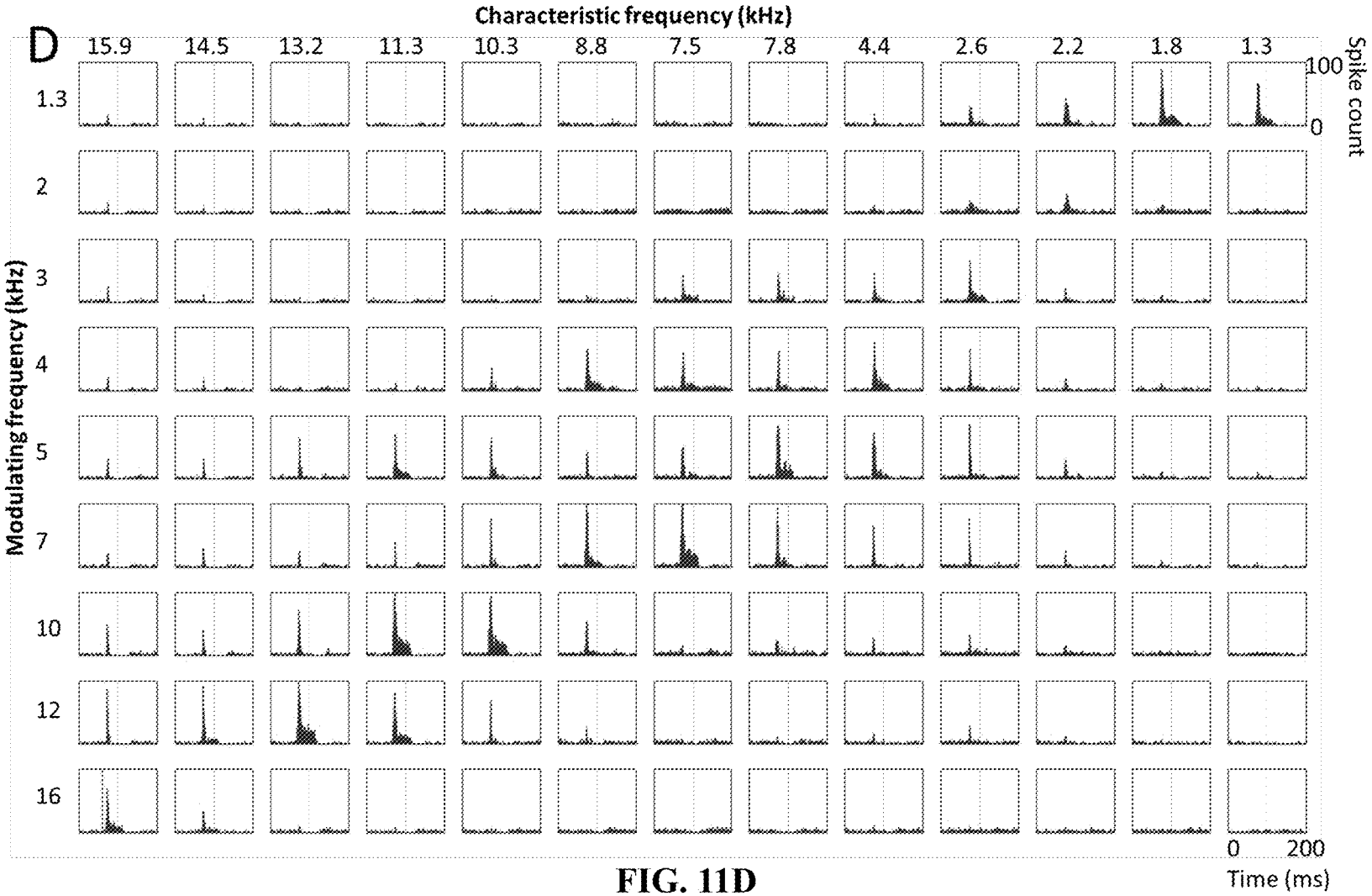
FIG. 11D shows the driven activity observed in 13 channels evoked by 9 different ultrasound stimulation waveforms at 10 kPa with a 220 kHz center frequency.
Figure 11E:
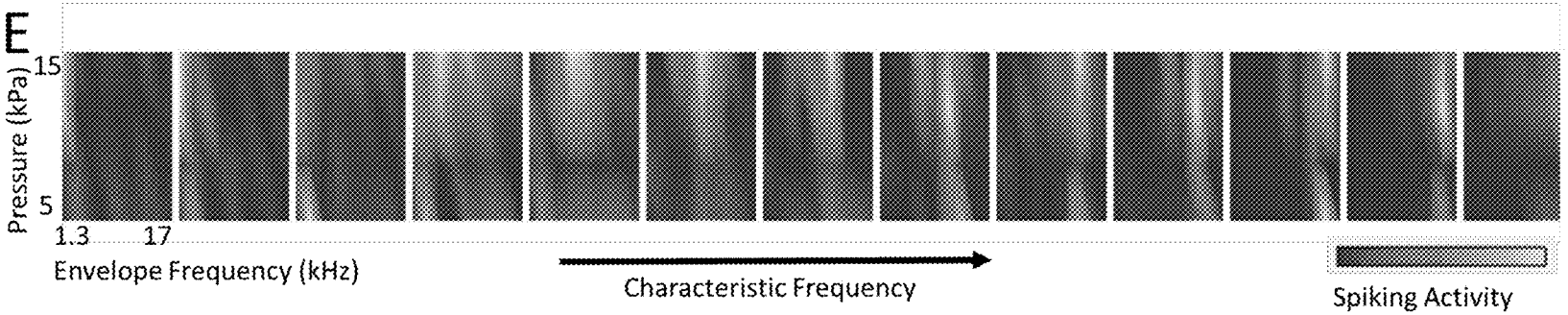
FIG. 11E shows tuning curves across 13 electrodes situated in the ICC. Each image represents spiking activity across 3 ultrasound pressure levels and 13 envelope waveforms for a single channel.

The left side of the subject animal's head was stimulated utilizing 13 different ultrasound stimulation waveforms spanning part of the audible frequency hearing range (1.3-40 kHz) and the driven spike activity was plotted for the first 200 ms of each trial. For each stimulus, recordings were obtained from 32 channels spanning the tonotopic organization of the ICC. FIG. 11D shows the driven activity observed in 13 channels evoked by 9 different ultrasound stimulation waveforms at 10 kPa with a 220 kHz center frequency. The onset of the stimulus is demonstrated by the red vertical bar (shown in the lower left corner panel in FIG. 11D). The remaining envelope frequencies did not induce selective activity at the locations from which recordings were obtained. It is possible to observe a change in the driven channel depending on the envelope frequency; as modulating frequency increases, the driven activity in neural populations with higher characteristic frequencies also increases. In other trials, increasing pressure levels also resulted in an increase of driven activity. FIG. 11E demonstrates that for the majority of the channels, as pressure increased, the driven activity for the characteristic frequency also increased. In order to ensure that this activity was not elicited by an air-conducted stimulus, control trials with the transducer decoupled from the animal were performed, with the result that no activity could be detected even at higher pressures (40 kPa). This suggests that the ultrasonic stimulus is demodulated at the cochlea and will lead to the perception of the envelope frequency in an awake subject.

Histological Analysis of Ultrasound Stimulation

Figure 11F:
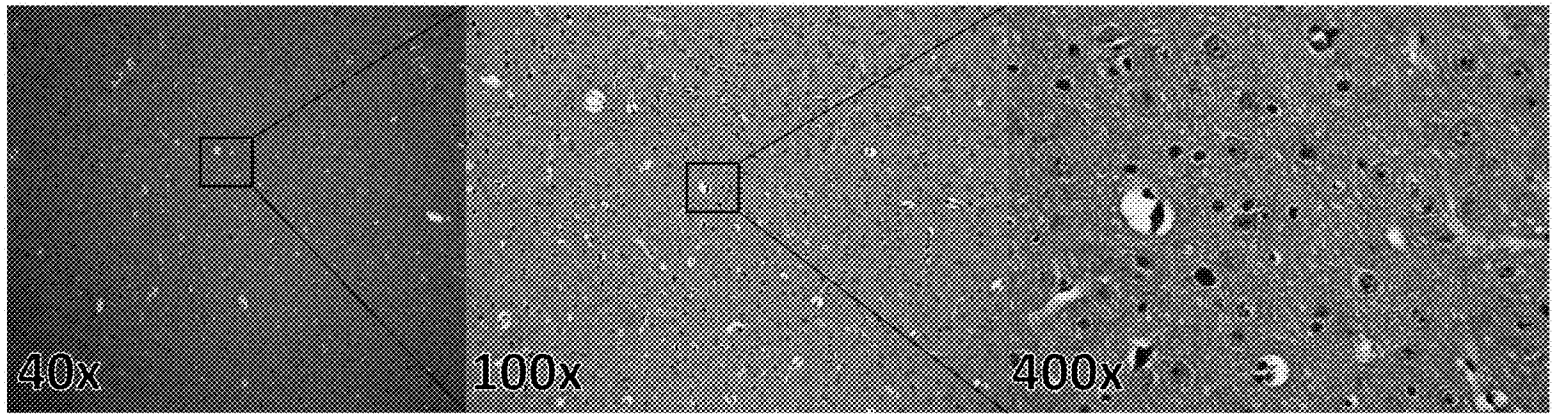
FIG. 11F shows an example tissue section of a low pressure, moderate duty cycle (100 kPa, 25%) parameter setting showing healthy tissue in the left temporal lobe of the guinea pig cortex at different magnifications: 40×, 100×, 400×. The black rectangles show magnification of regions of interest.

The common mechanisms of damage that can occur from US are heating, cavitation, and microhemorrhages. All of these mechanisms can be present in minor forms from stimulation without causing actual tissue damage. Tissue sections were imaged and analyzed to look for signs of damage including: scarring, edema, cell necrosis, and local inflammatory responses. As shown in FIG. 11F, no noticeable tissue damage was observed for ultrasound stimulation using parameters that could elicit strong auditory activation.

It is to be understood that the above description is intended to be illustrative, and not restrictive. The present disclosure has described one or more preferred embodiments, and it should be appreciated that many equivalents, alternatives, variations, and modifications, aside from those expressly stated, are possible and within the scope of the invention. Other embodiments will be apparent to those of skill in the art upon reading and understanding the above description. It should be noted that embodiments discussed in different portions of the description or referred to in different drawings can be combined to form additional embodiments of the present application. The scope should, therefore, be determined with reference to the appended claims, along with the full scope of equivalents to which such claims are entitled.

What is claimed is:

1. A hearing system for stimulating an auditory system for sound perception by activating a particular region of a cochlea of a user using ultrasound signals, the particular region corresponding to a target frequency range, the system comprising:

an ultrasonic transducer configured to deliver an ultrasound signal via an interface medium; and a processor communicatively coupled to the ultrasonic transducer, the processor to:

obtain an audio signal, extract at least one of a temporal feature or a spectral feature from the audio signal, transpose the audio signal to the target frequency range based on extracting the at least one of the temporal feature or the spectral feature from the audio signal, generate a modulated ultrasound signal based on modifying a carrier signal having at least one frequency greater than 200 kHz and less than or equal to 4 MHz by the transposed audio signal, and provide the modulated ultrasound signal to the ultrasonic transducer for delivery via an interface medium.

2. The hearing system of claim 1, wherein the particular region of the cochlea comprises at least one of an edge region or an underused portion of the cochlea.

3. The hearing system of claim 1, wherein the processor, when modifying the carrier signal by the transposed audio signal, is further to multiply the carrier signal by the transposed audio signal.

4. The hearing system of claim 1, wherein the processor, prior to transposing the audio signal, is further to preprocess the audio signal by applying half-wave rectification to the audio signal.

5. The hearing system of claim 1, wherein the processor, prior to transposing the audio signal, is further to preprocess the audio signal by applying low-pass filtering to the audio signal.

6. The hearing system of claim 1, wherein the processor, when transposing the audio signal, is further to transpose frequencies in the audio signal by multiplying the audio signal by the target frequency range.

7. The hearing system of claim 1, wherein the processor, when transposing the audio signal, is further to:

transpose frequencies in the audio signal by converting the audio signal from the time domain to the frequency domain, shift the frequencies to the target frequency range, and convert the audio signal from the frequency domain back to the time domain.

8. The hearing system of claim 1, wherein the processor is further to stretch or compress the audio signal in the time domain.

9. The hearing system of claim 1, wherein, when the ultrasonic transducer is positioned on the body of the user and is used to deliver the modulated ultrasound signal to the user, the ultrasound signal stimulates the cochlea via vibration of cochlear fluids.

10. The hearing system of claim 1, further comprising a plurality of ultrasonic transducers, wherein each of the plurality of ultrasonic transducers is positioned on a head of the subject in association with at least one of the asterion, pterion, bregma, lambda, or zygomatic arch.

11. A hearing system for stimulating an auditory system for sound perception by activating a particular region of a cochlea of a user using ultrasound signals, the particular region corresponding to a target frequency range, the system comprising:

a plurality of ultrasonic transducers, each configured to deliver an ultrasound signal via an interface medium; and a processor communicatively coupled to the ultrasonic transducer, the processor to:

obtain an audio signal, extract a plurality of frequency bands from the audio signal, independently amplify each frequency band of the plurality of frequency bands, transpose the plurality of frequency bands of the audio signal to the target frequency range based on independently amplifying each frequency band of the plurality of frequency bands, generate a plurality of modulated ultrasound signals based on the respective plurality of transposed frequency bands, modify a plurality of carrier signals each having at least one frequency between 50 kHz and 4 MHz by the respective plurality of modulated ultrasound signals, and provide each of the plurality of modified carrier signals to each of the respective plurality of ultrasonic transducers for delivery via an interface medium, at least two of the plurality of ultrasonic transducers being associated with different regions of the body of the user.

12. The hearing system of claim 1, wherein the processor, when extracting at least one of the temporal feature or the spectral feature from the audio signal, is further to extract the at least one of the temporal feature or the spectral feature using at least one of an envelope extractor, a Hilbert Transform, or a low-pass filter.

13. The hearing system of claim 1, wherein the ultrasonic transducer further comprises phased array transducers having ultrasound elements configured to be stimulated with phases and magnitudes selected to beamform ultrasound energy to a focal location in the head or directly to the cochlea or cochlear fluid.

14. The hearing system of claim 1, wherein the target frequency range is between 6 kHz and 15 kHz.

15. The hearing system of claim 1, wherein the particular region of the cochlea is associated with treatment of a symptom of tinnitus in the user, and wherein the processor, when providing the modulated ultrasound signal, is further to:

provide the modulated ultrasound signal to the ultrasonic transducer for delivery via the interface medium to reduce or eliminate the symptom of tinnitus in the user.

16. The hearing system of claim 1, wherein the processor, when providing the modulated ultrasound signal to the ultrasonic transducer for delivery via the interface medium, is further to:

provide a first modulated ultrasound signal and a second modulated ultrasound signal to the ultrasonic transducer for delivery via the interface medium, the first modulated ultrasound signal corresponding to a first audio signal and the second modulated ultrasound signal corresponding to a second audio signal different from the first audio signal, and the first modulated ultrasound signal corresponding to a first target frequency range and the second modulated ultrasound signal corresponding to a second target frequency range different from the first target frequency range, at least one of the first target frequency range or the second target frequency range being determined based on input received from the user.

17. A method for stimulating an auditory system for sound perception by activating a particular region of a cochlea of a user using ultrasound signals, the particular region corresponding with a target frequency range, the method comprising:

obtaining, by a processor, an audio signal;

extracting, by the processor, a temporal feature from the audio signal using at least one of an envelope extractor or a Hilbert Transform;

transposing, by the processor, the audio signal to the target frequency range based on extracting the temporal feature from the audio signal;

generating, by the processor, a modulated ultrasound signal based on modifying a carrier signal having at least one frequency between 50 kHz and 4 MHz by the transposed audio signal;

providing, by the processor, the modulated ultrasound signal to an ultrasonic transducer configured to deliver an ultrasound signal via an interface medium; and delivering, by the ultrasonic transducer, the modulated ultrasound signal to one or more portions of the body of the user to stimulate the cochlea via vibration of cochlear fluids.

18. The method of claim 17, wherein the particular region of the cochlea comprises at least one of an edge region or an underused portion of the cochlea.

19. The method of claim 17, wherein modifying the carrier signal by the transposed audio signal further comprises multiplying the carrier signal by the transposed audio signal.

20. The method of claim 17, wherein, prior to transposing the audio signal, the method further comprises preprocessing the audio signal by applying half-wave rectification to the audio signal.

21. The method of claim 17, wherein, prior to transposing the audio signal, the method further comprises preprocessing the audio signal by applying low-pass filtering to the audio signal.

22. The method of claim 17, wherein transposing the audio signal further comprises transposing frequencies in the audio signal by multiplying the audio signal by the target frequency range.

23. The method of claim 17, wherein transposing the audio signal further comprises:

transposing frequencies in the audio signal by converting the audio signal from the time domain to the frequency domain, shifting the frequencies to the target frequency range, and converting the audio signal from the frequency domain back to the time domain.

24. The method of claim 17, further comprising stretching or compressing the audio signal in the time domain.

25. The method of claim 17, further comprising positioning a plurality of ultrasonic transducers on a head of the subject in association with at least one of the asterion, pterion, bregma, lambda, or zygomatic arch.

26. The method of claim 17, wherein extracting the temporal feature from the audio signal further comprises:

extracting a spectral feature from the audio signal, comprising:

extracting a plurality of frequency bands from the audio signal, and independently amplifying each frequency band of the plurality of frequency bands.

27. The method of claim 26, wherein generating the modulated ultrasound signal further comprises:

generating a plurality of modulated ultrasound signals based on the plurality of frequency bands, and wherein providing the modulated ultrasound signal further comprises:

providing each of the plurality of modulated ultrasound signals to each of a respective plurality of ultrasonic transducers, wherein at least two of the plurality of ultrasonic transducers is associated with a different region of the body of the user.

28. The method of claim 17, wherein extracting the temporal feature from the audio signal further comprises:

extracting a spectral feature using a low-pass filter.

29. The method of claim 17, wherein the ultrasonic transducer further comprises phased array transducers having ultrasound elements configured to be stimulated with phases and magnitudes selected to beamform ultrasound energy to a focal location in the head or directly to the cochlea or cochlear fluid.

30. The method of claim 17, wherein the target frequency range is between 6 kHz and 15 kHz.

31. The method of claim 17, wherein the particular region of the cochlea is associated with treatment of a symptom of tinnitus in the user, and wherein providing the modulated ultrasound signal further comprises:

providing the modulated ultrasound signal to the ultrasonic transducer for delivery via the interface medium to reduce or eliminate the symptom of tinnitus in the user.

32. The method of claim 17, wherein providing the modulated ultrasound signal to the ultrasonic transducer for delivery via the interface medium further comprises:

providing a first modulated ultrasound signal and a second modulated ultrasound signal to the ultrasonic transducer for delivery via the interface medium, the first modulated ultrasound signal corresponding to a first audio signal and the second modulated ultrasound signal corresponding to a second audio signal different from the first audio signal, and the first modulated ultrasound signal corresponding to a first target frequency range and the second modulated ultrasound signal corresponding to a second target frequency range different from the first target frequency range, at least one of the first target frequency range or the second target frequency range being determined based on input received from the user.

* * * * *